US007690757B2

(12) United States Patent
Kusunoki et al.

(10) Patent No.: US 7,690,757 B2
(45) Date of Patent: Apr. 6, 2010

(54) HEAD CAPPING MEMBER, HEAD MAINTENANCE OR RECOVERY DEVICE, DEVICE FOR EJECTING A LIQUID DROP, AND IMAGE FORMING APPARATUS

(75) Inventors: Masanori Kusunoki, Kanagawa (JP); Nobuyuki Akaishi, Kanagawa (JP); Tetsuya Hiruma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 554 days.

(21) Appl. No.: 11/709,378

(22) Filed: Feb. 21, 2007

(65) Prior Publication Data

US 2007/0206048 A1 Sep. 6, 2007

(30) Foreign Application Priority Data

Feb. 22, 2006 (JP) ..... 2006-045954
Nov. 8, 2006 (JP) ..... 2006-302173

(51) Int. Cl.
*B41J 2/165* (2006.01)

(52) U.S. Cl. ..... 347/29; 347/32

(58) Field of Classification Search ..... 347/29–32, 347/100

See application file for complete search history.

(56) References Cited

U.S. PATENT DOCUMENTS 4,279,653 A * 7/1981 Makishima et al. ..... 106/31.32
6,481,826 B1 * 11/2002 Hara et al. ..... 347/29
6,729,716 B2 5/2004 Eguchi et al.
2004/0207671 A1 10/2004 Kusunoki et al.
2005/0168517 A1 8/2005 Usuda
2007/0052750 A1 3/2007 Tokuno et al.

FOREIGN PATENT DOCUMENTS

JP 2002-240325 8/2002
JP 2005-271458 10/2005
WO WO2005/092627 A1 10/2005

OTHER PUBLICATIONS

Aug. 7, 2007 European Search Report in connection with corresponding European patent Application No. 07 05 0707.

* cited by examiner

*Primary Examiner*—Shin-Wen Hsieh
(74) *Attorney, Agent, or Firm*—Cooper & Dunham LLP

(57) ABSTRACT

A head capping member for capping an ejection face of a liquid ejecting head which face is provided with a nozzle for ejecting a liquid drop is provided, which includes a contact part which contacts the ejection face of the head and is made of an elastic member and a recess which forms a closed space together with the ejection head when the contact part contacts the ejection head, wherein a flat part is formed around the recess and an absorbing member is provided on the flat part so as to cover the recess.

19 Claims, 15 Drawing Sheets

HEAD CAPPING MEMBER, HEAD MAINTENANCE OR RECOVERY DEVICE, DEVICE FOR EJECTING A LIQUID DROP, AND IMAGE FORMING APPARATUS

BACKGROUND

1. Technical Field

This disclosure relates to a head capping member, a head maintenance or recovery device, a device for ejecting a liquid drop, and an image forming apparatus.

2. Description of the Related Art

As an image forming apparatus such as a printer, a facsimile, a copying machine, and a composite machine thereof, for example, an ink jet recording apparatus is known. Such an ink jet recording apparatus conducts recording (for example, image formation, image printing, character printing, and printing may be used as synonyms.) by ejecting an ink drop as a drop of liquid (recording liquid) onto a medium to be recorded such as a recording paper (hereinafter, it may be referred to as a "paper sheet", the material of which is not limited to paper, and it may be also referred to as a recording medium, a transfer paper, a transfer material and a material to be recorded) from a recording head composed of a liquid ejecting head(s).

Thus, in a device for ejecting a liquid drop from a liquid ejecting head, a maintenance or recovery mechanism (device) for maintaining or recovering the reliability of the head is essential for preventing loss of normal ejection thereof, since a foreign matter such as thickened or dried ink, dust and contaminants adheres to the outer face of nozzle of the head so as to cause the clogging of the nozzle or an air-damper phenomenon is caused by, for example, the generation of air bubbles, at the inside of the nozzle.

The maintenance or recovery mechanism has a cap (capping member) for sealing the nozzle face (liquid drop ejecting face) of the head. Also, for example, an operation (head suction or nozzle suction) of sucking ink provided from the nozzle and filled in the head using suction means such as a suction pump communicating with the inside of the cap, an operation of wiping the head surface with a wiper blade for which an elastic material such as rubber is used, and a blank ejection operation (also refereed to as a preliminary ejection operation) of ejecting thickened ink or mixed color ink located on the inside of the nozzle and around the outlet thereof by ejecting ink such that no influence is provided to image formation, are appropriately combined, so as to conduct an operation of removing, for example, bubbles in a liquid chamber, thickened ink and adhering contaminants, thereby keeping the condition which can conduct stable liquid drop ejection.

One of conventional capping means, as disclosed in Japanese Patent Application Publication No. 2002-240325, includes a capping member on which a recess and a suction port are formed, and a capillary force generation member which is formed separately from the capping member, forms gap with a wall constituting the recess and is arranged so as to generate capillary force against a face of the recess on which face a suction port communicating with suction means is formed, and, thereby, reduces the amount of remaining ink in the capping member.

Also, another one, as disclosed in Japanese Patent Application Publication No. 2005-271458, provides at least two inclined planes inclining toward an outlet on the bottom portion of a capping member, wherein the sum of the angle of the inclined plane with respect to the horizontal plane and the contact angle of a recording liquid drop with respect to a member forming the inclined plane is equal to or greater than 70°, whereby the amount of remaining highly viscous recording liquid in the capping member can be reduced.

As also disclosed in Japanese Patent Application Publication No. 2005-271458 described above, characteristics required for recording liquid (ink) for ink jet recording are color tone, image density, bleeding, etc., for attaining a high image quality, dissolution or dispersion stability, storage stability, ejection stability, etc., of a coloring agent in ink, for attaining the reliability, water resistance, light fastness, etc., for retaining the keeping quality of a recorded image, the quick-drying property of ink, etc., for attaining the speeding-up, and, conventionally, various attempts to satisfy these requirements have been made. For example, as a coloring agent for ink, dye inks were initially trend in view of the good coloring property or high reliability thereof, but, recently, ink compositions for which a pigment such as carbon blacks tends to be used in order to provide a recorded image with a certain light fastness or water resistance.

Then, approaches for suppressing the viscosity rise of a conventional recording liquid as much as possible have been examined in order to improve the reliability of an image forming apparatus, but it is necessary to use a highly viscous recording liquid in order that a high quality image can be formed on a normal paper sheet.

Herein, when, for example, a recording liquid is used which is prepared to contain, at least, a coloring agent and wetting agent dispersible in water and to rapidly thicken (the rate of viscosity rise (mPa·s/%) being over 50) in a water evaporation rate of 30-45% to the initial weight, a significant improvement may be found against nozzle failure (defective ejection) caused by the clogging of nozzle with, for example, a dye precipitate or the solid content of a dispersion-instable pigment, a new problem which is considered not to occur in the conventional recording liquid has been found, due to the evaporation rate—viscosity characteristic.

That is, a phenomenon has been found such that recording liquid adhering to and remaining on the inside of a suction cap, for example, as a result of a maintenance or recovery operation such as cleaning, eliminates water from the nozzle of the head and, thereby, defective ejection is caused.

As described more specifically, the maintenance or recovery mechanism includes a suction cap for capping the nozzle face of a recording head and sucking and ejecting recording liquid from the nozzle, but when printing is continued for a long time, the recording liquid ejected to and remaining on the inside of the suction cap due to the maintenance or recovery mechanism dries according to the environment of the placed apparatus. Then, when the recording head is capped with the suction cap in such a condition, the recording liquid in a dry condition eliminates water content from the recording liquid in the nozzle, that is, the water content of the recording liquid in the nozzle of the recording liquid is eliminated, thereby causing rapid viscosity rise thereof. As a result, the recording liquid in the nozzle is thickened so as to cause the clogging thereof and the defective ejection.

From such a viewpoint, it is necessary to surely prevent the recording liquid from remaining in the cap, but there is a problem such that a capping member utilizing capillary action as disclosed in Japanese Patent Application Publication No. 2002-240325 could provide no solution when the recording liquid with a high viscosity and a high rate of viscosity rise as described above is used, and there is also a problem such that a capping member as disclosed in Japanese Patent Application Publication No. 2005-271458 could not necessarily prevent the recording liquid from remaining.

BREIF SUMMARY

According to an aspect of this disclosure, there is provided a head capping member for capping an ejection face of a liquid ejecting head which face is provided with a nozzle for ejecting a liquid drop, which comprises a contact part which contacts the ejection face of the head and is made of an elastic member and a recess which forms a closed space together with the ejection head when the contact pan contacts the ejection head, wherein a flat part is formed around the recess and an absorbing member is provided on the flat part so as to cover the recess.

According to another aspect of this disclosure, there is provided a head maintenance or recovery device for conducting maintenance or recovery of a liquid ejecting head, comprising a capping member for capping an ejection face of the liquid ejecting head, from which face a liquid drop is ejected, wherein the capping member is the head capping member as described above.

According to another aspect of this disclosure, there is provided a device for ejecting a liquid drop from a liquid ejecting head, which comprises the head maintenance or recovery device as described above.

According to another aspect of this disclosure, there is provided an image forming apparatus for forming an image by ejecting a liquid drop from a liquid ejecting head, which comprises the head maintenance or recovery device as described above.

DETAILED DESCRIPTION OF THE PREFERRED EMBODIMENTS

Embodiments of the present invention are described below, with reference to the accompanying drawings.

Figure 1:
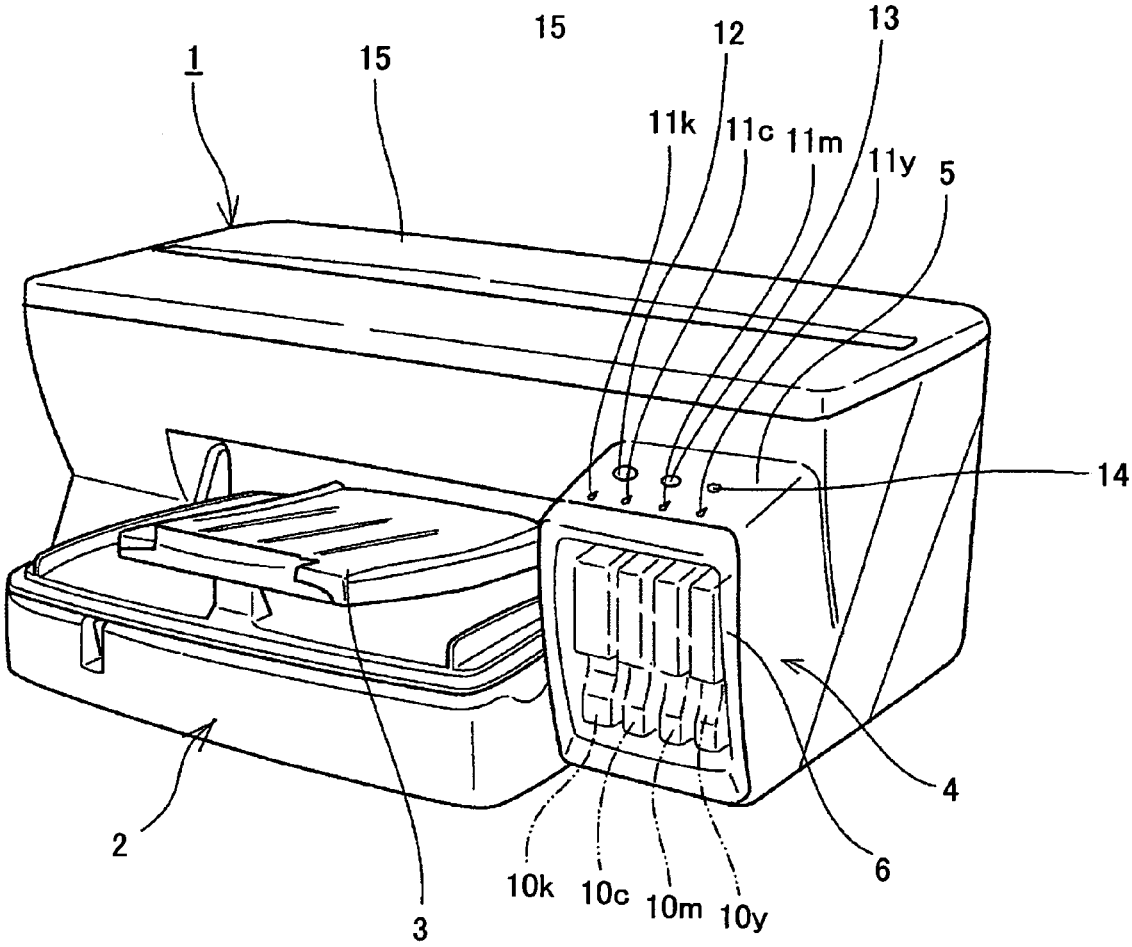
FIG. 1 is a front perspective view which schematically shows one example of an image forming apparatus according to the present invention.

FIG. 1 is a perspective view which schematically shows one example of an image forming apparatus according to the present invention, which apparatus is viewed from the front side of the image formation apparatus and is a device of ejecting a liquid drop according to an embodiment of the present invention.

The image forming apparatus includes an apparatus body 1, a paper feed tray 2 for charging a paper sheet which tray is installed in the apparatus body 1, and a paper ejection tray 3 for stacking a paper sheet on which an image is recorded (formed) which tray is detachably installed in the apparatus body 1. Further, at one side of the front face of the apparatus body 1 (one lateral side of the paper feed and paper ejection trays), a cartridge installation part 4 for installing an ink cartridge which part projects from the front face to the front side of the apparatus body 1 and is located below the top face thereof is included and an operation/indication part 5 on which an operation button and an indicator are provided is provided on the top face of the cartridge installation part 4.

Plural ink cartridges 10*k*, 10*c*, 10*m*, and 10*y* which are recording liquid cartridges for containing recording liquids (inks) whose colors are different from each other, for example, a black (K) ink, a cyan (C) ink, a magenta (M) ink, and a yellow (Y) ink (which cartridges are referred to as "ink cartridges 10" when there is no need to distinguish the colors) can be installed in the cartridge installation part 4 by inserting them from the front face of the apparatus body 1 toward the backside thereof. At the side of the front face of the cartridge installation part 4, a front cover (cartridge cover) 6 which is opened when the ink cartridges 10 are attached or detached is provided so that it can be opened or closed.

Also, remaining quantity indication parts 11*k*, 11*c*, 11*m*, and 11*y* for the respective colors which indicate that the quantities of remaining inks in the ink cartridges for respective colors 10*k*, 10*c*, 10*m* and 10*y* are in the condition of near-end or end are arranged on the operation/indication part 5 at installation positions corresponding to the installation positions (arrangement positions) of the ink cartridges for respective colors 10*k*, 10*c*, 10*m*, and 10*y*. Further, the operation/installation part 5 is also provided with a power supply button 12, a paper sending/printing restart button 13, and a cancel button 14.

Figure 2:
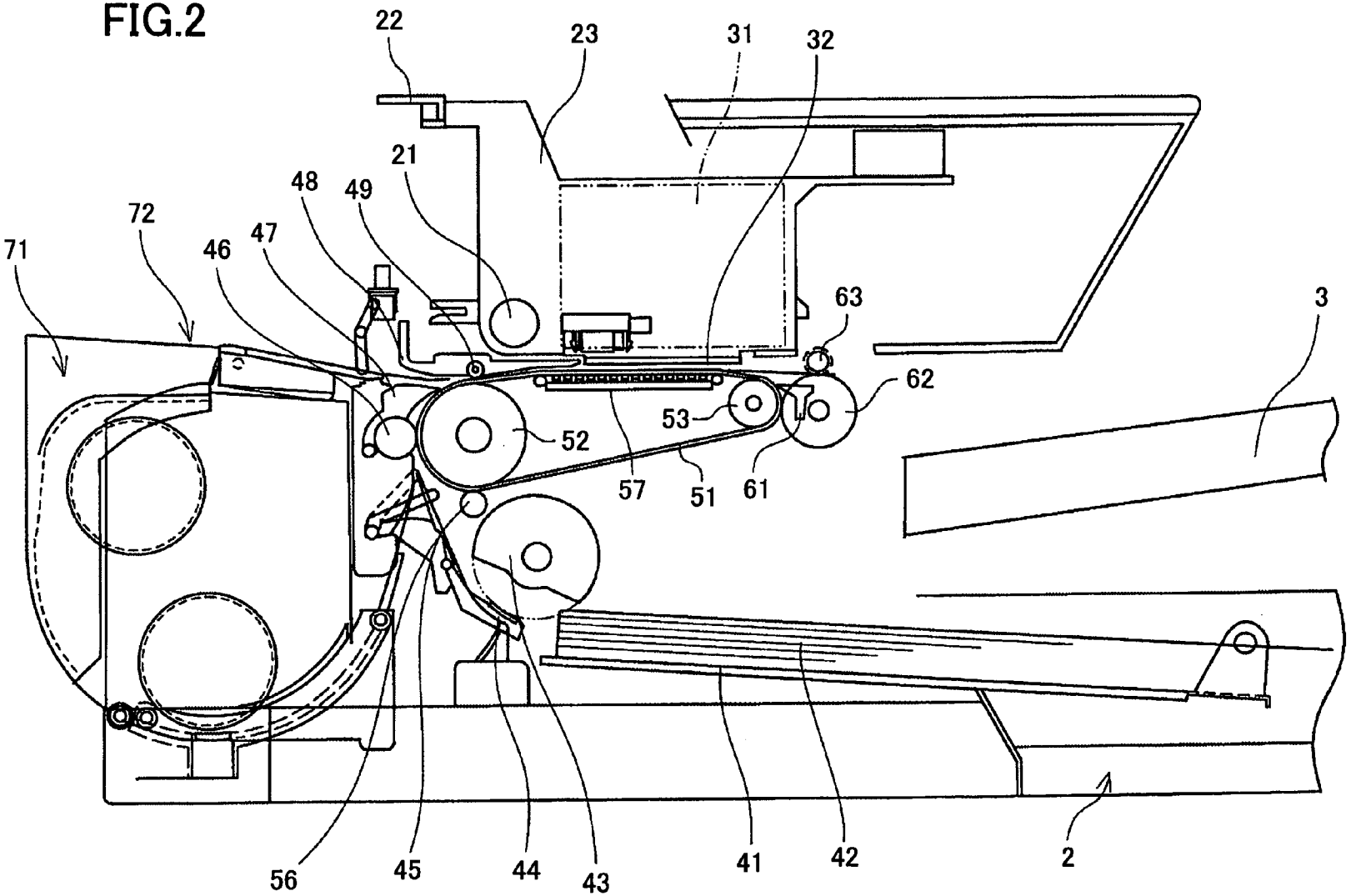
FIG. 2 is a diagram showing the general configuration of a mechanical part of the image forming apparatus.

Next, a mechanical part of the image forming apparatus is described with reference to FIG. 2 and FIG. 3. Herein, FIG. 2 is a schematic configuration diagram illustrating the entire structure of the mechanical part and FIG. 3 is a plan view illustrating an essential part of the mechanical part.

Figure 3:
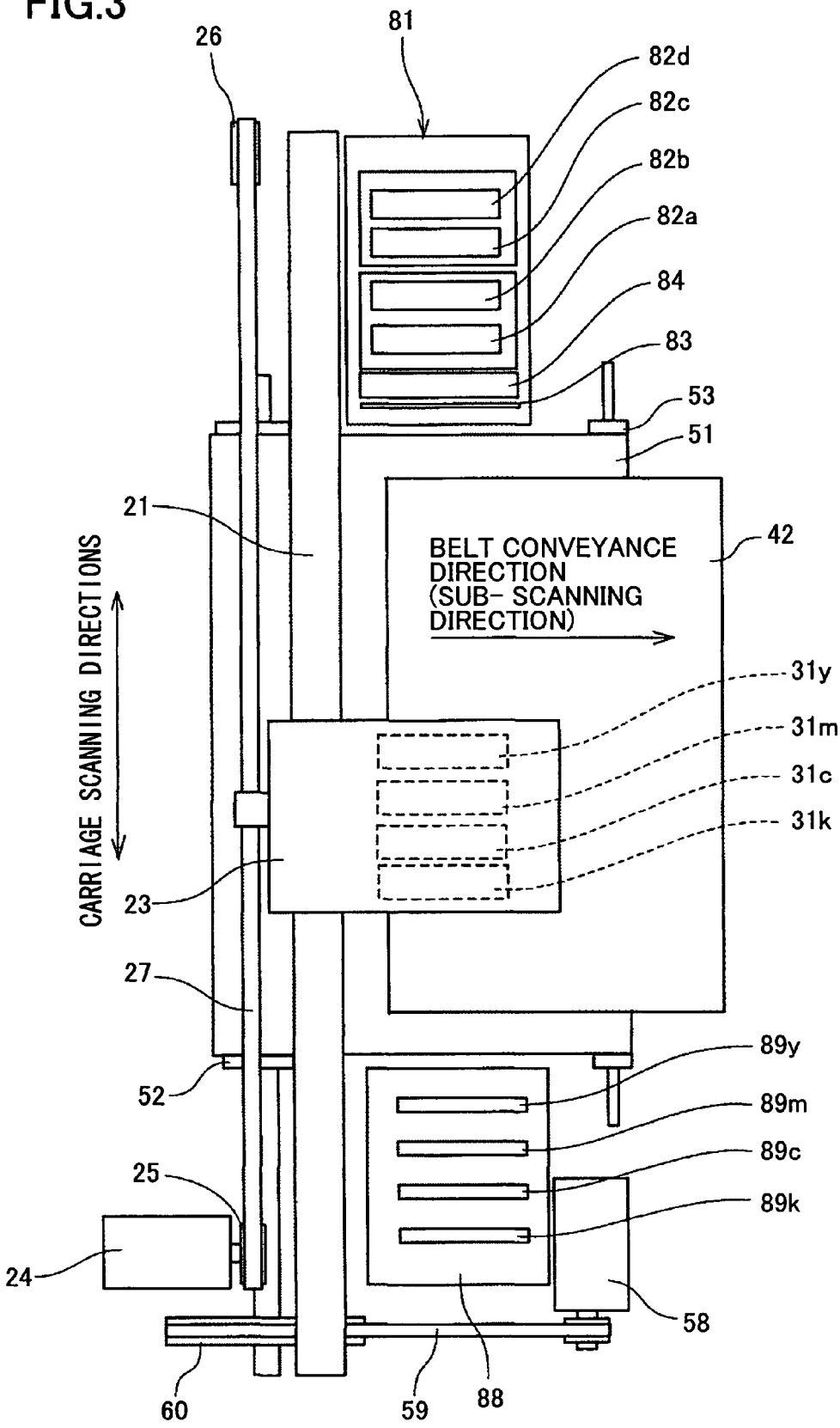
FIG. 3 is a plan view illustrating the essential part of the mechanical part.

A carriage 23 is held slidably in main-scanning directions by a guide rod 21 as a guide member extending between left and right side plates which are not shown in the figures and a stay 22, and is moved for scanning in the directions of an arrow (carriage main-scanning directions; main-scanning directions) in FIG. 3 by using a main scanning motor 24 and a timing belt 27 which extends on a driving pulley 25 and a driven pulley 26.

Recording heads 31*k*, 31*c*, 31*m*, and 31*y* (referred to as a "recording head 31" when they are not distinguished) composed of liquid drop ejecting heads for ejecting an ink drop of respective colors, that is, yellow (Y), cyan (C), magenta (M), and black (B) are mounted on the carriage 23 such that plural ink ejecting ports thereof are arranged in directions intersected with the main-scanning directions and the direction of ink drop ejection is downward.

As an ink jet head constituting the recording head 31, there can be used one provided with a piezoelectric actuator such as a piezoelectric element, a thermal actuator that utilizes phase change of liquid by using an electro-thermal conversion element such as an exothermic resistor, a shape memory alloy actuator using a metal phase change dependent on temperature change, and an electrostatic actuator using an electrostatic force, as a pressure generation device for generating a pressure for ejecting a liquid drop. Also, the ink jet head has plural nozzle sequences for which sequence plural nozzles are aligned and may have a configuration such that a liquid drop of the same color is ejected from each nozzle sequence or a configuration such that ink drops of different colors are ejected.

Also, head-tanks 32 for respective colors which supply inks of respective colors to the recording head 31 are mounted on the carriage 23. To the head-tanks 32 for respective colors, inks of respective colors are supplied or provided from ink cartridges 10 for respective colors installed on the cartridge installation part 4, through tubes for supplying inks of respective colors.

Meanwhile, a paper feeding part as feeding means for feeding a paper sheet 42 stacked on a paper stacking part (pushing plate) 41 of the paper feed tray 2 includes a half-moon-shaped control roller (paper feeding control roller) 43 for separating and feeding paper sheets 42 from the paper stacking part 41 piece by piece and a separation pad 44 opposing the paper feeding control roller 43 and made of a material with a large coefficient of friction, wherein the separation pad 44 is pushed to the side of the paper feeding control roller 43.

Then, a guide member 45 for guiding a paper 42, a counter-roller 46, a conveyance guide member 47, and a pushing member 48 having a tip pushing control roller 49 are included and a conveyer belt 51 which is one of conveying means for electrostatically attaracting the fed and sent paper sheet 42 and conveying it through the location opposing the recording head 31 is also included, in order to send the paper sheets 42 fed from the paper feed part to the downside of the recording head 31.

The conveyer belt 51 is a no-end-type belt and is configured to extend on a conveyance roller 52 and a tension roller 53 and revolve in a belt conveyance direction (sub-scanning direction). The conveyance belt 51 has, for example, a front layer as a sheet attracting face which is formed from a pure resin material, for example, an ETFE pure material, with a thickness of 40 μm, to which no resistance control is applied, and a back layer (intermediately resistive layer, earth-layer) which includes the same material as that of the front layer and to which a resistance control with carbon has been applied.

Further, a charging roller 56 is included as charging means for charging the surface of the conveyance belt 51. The charging roller 56 contacts the front layer of the conveyance belt 51 and is arranged to be driven by the revolution of the conveyance belt 51 and, thereby, revolve, and both ends of the shaft are pushed with a certain pressure. Additionally, the conveyance roller 52 also has the function of an earth-roller and is arranged to contact the intermediately resistive layer (back layer) of the conveyance belt 51 and, thereby, be grounded.

Also, a guide member 57 is arranged at the backside of the conveyance belt 51 so as to oppose an image printing area for the recording head 31. The guide member 57 maintains the highly precise planarity of the conveyance belt 51 by projecting the top face thereof at the side of the recording head 35 from the tangential lines of the two rollers (the conveyance roller 52 and the tension roller 53) which support the conveyance belt 51.

The conveyance belt 51 rotationally moves in the belt conveyance direction (sub-scanning direction) shown in FIG. 3 due to the conveyance roller 52 driven and rotated by a sub-scanning motor 58 via a driving belt 59 and a pulley 60.

Furthermore, a paper ejection part for ejecting the paper sheet 42 on which recording is made by the recording head 31 includes a separation claw 61 for separating the paper sheet 42 from the conveyance belt 51, a paper sheet ejection roller 62, and a paper sheet ejection control roller 63, and a paper sheet ejection tray 3 below the paper sheet ejection roller 62.

Meanwhile, a double-side unit 71 is detachably installed at the backside of the apparatus body 1. The double-side unit 71 receives and reverses the paper sheet 42 which is returned by the counter-revolution of the conveyance unit 51, and feeds it between the counter-roller 46 and the conveyance belt 51 again. Also, the top face of the double-side unit 71 is used as a manual feed tray 72.

Further, as shown in FIG. 3, a maintenance or recovery mechanism 81 is arranged as a maintenance or recovery device for head according to the present invention for maintaining or recovering the condition of a nozzle of the recording head 31 in a non-printing area at one side of the directions of scanning of the carriage 33.

The maintenance or recovery mechanism 81 includes respective cap members (referred to as "caps" below) 82*a*-82*d* (referred to as a "cap 82" when they are not distinguished) for capping respective nozzle faces of the recording head 31, a wiper blade 83 which is a blade member for wiping the nozzle face, and a blank ejection receiver 84 for receiving a liquid drop when blank ejection is conducted for ejecting a liquid drop which does not contribute to recording in order to eject thickened recording liquid. Herein, the cap 82*a* is used as a suction and moisture retention cap (referred to as a "suction cap" below) and the other caps 82*b*-82*d* are used as moisture retention caps.

Also, a blank ejection receiver 88 for receiving a liquid drop when the blank ejection is conducted for ejecting a liquid drop which does not contribute to recording in order to eject recording liquid thickened during the recording, is arranged on a non-printing area at the other side of the scanning directions of the carriage 23, and the blank ejection receiver 88 is provided with apertures 89 along the directions of the sequence of the nozzles of the recording head 34.

In thus configured image forming apparatus, the paper sheets 42 are separated and fed from the paper feed tray 2 piece by piece. Then, the paper sheet 42 which is generally sent in the vertical and upward direction is guided by the guide 45, sandwiched between the conveyer belt 51 and the counter-roller 46, and conveyed. Further, the tip thereof is guided by a conveyance guide 37 and it is pushed to the conveyer belt 51 by the tip pushing control roller 49, so that the conveyance direction thereof is changed by approximately 90 degrees.

At this time, a plus output and a minus output are alternately and repeatedly applied, that is, an alternating voltage is applied, from an AC bias supplying part to the charging roller 56, due to a control part which is not shown in the figure, and the conveyer belt 51 is charged in an alternating charging voltage pattern, that is, in a pattern of alternating plus and minus strips with a predetermined width in the sub-scanning direction which is the revolving direction. As the paper sheet 42 is fed on the conveyance belt 51 which is plus- and minus-charged alternatively, the paper sheet 42 is attracted onto the conveyance belt 51 and the paper sheet 42 is conveyed in the sub-scanning direction by the rotational movement of the conveyance belt 51.

Herein, ink drops are ejected on the paper sheet 42 at a stop by driving the recording head 31 in response to an image signal while the carriage 23 is moved, so as to record one line, and after the paper sheet 42 is conveyed by a predetermined distance, recording of a next line is conducted. Recording operations are finished by receiving a recording completion signal or a signal indicating that the rear end thereof reaches a recording area, and the paper sheet 42 is ejected onto the paper ejection tray 3.

Also, the carriage 23 is moved to the side of the maintenance or recovery mechanism 81 during a waiting for printing (recording) and the recording head 31 is capped with the cap 82 so as to keep the nozzle at the wetted condition, whereby defective ejection caused by drying of ink is prevented. Also, recording liquid is sucked from the nozzle (as referred to as "nozzle suction" or "head suction") by an suction pump which is not shown in the figure, on the condition that the recording head 31 is capped with the cap 82, whereby a recovery operation for ejecting thickened recording liquid or air bubbles is conducted. Also, a blank ejection operation for ejecting ink which does not relate to recording is conducted before the start of the recording or during the recording. Thereby, the stable ejection performance of the recording head 31 is maintained.

Figure 4:
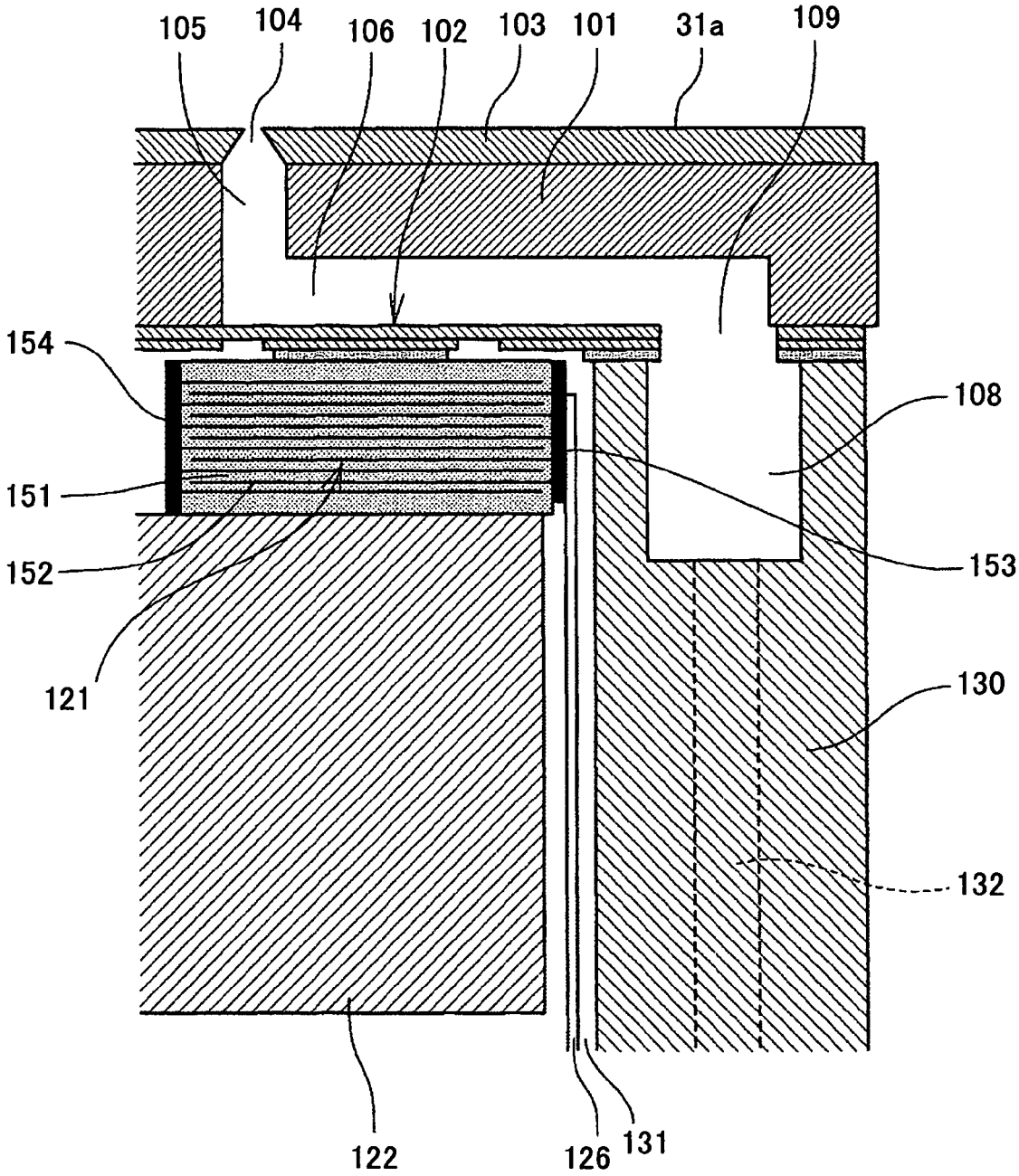
FIG. 4 is a cross-section diagram which schematically shows one example of a liquid drop ejecting head which constitutes a recording head of the image forming apparatus along the longitudinal directions of a liquid chamber.
Figure 5:
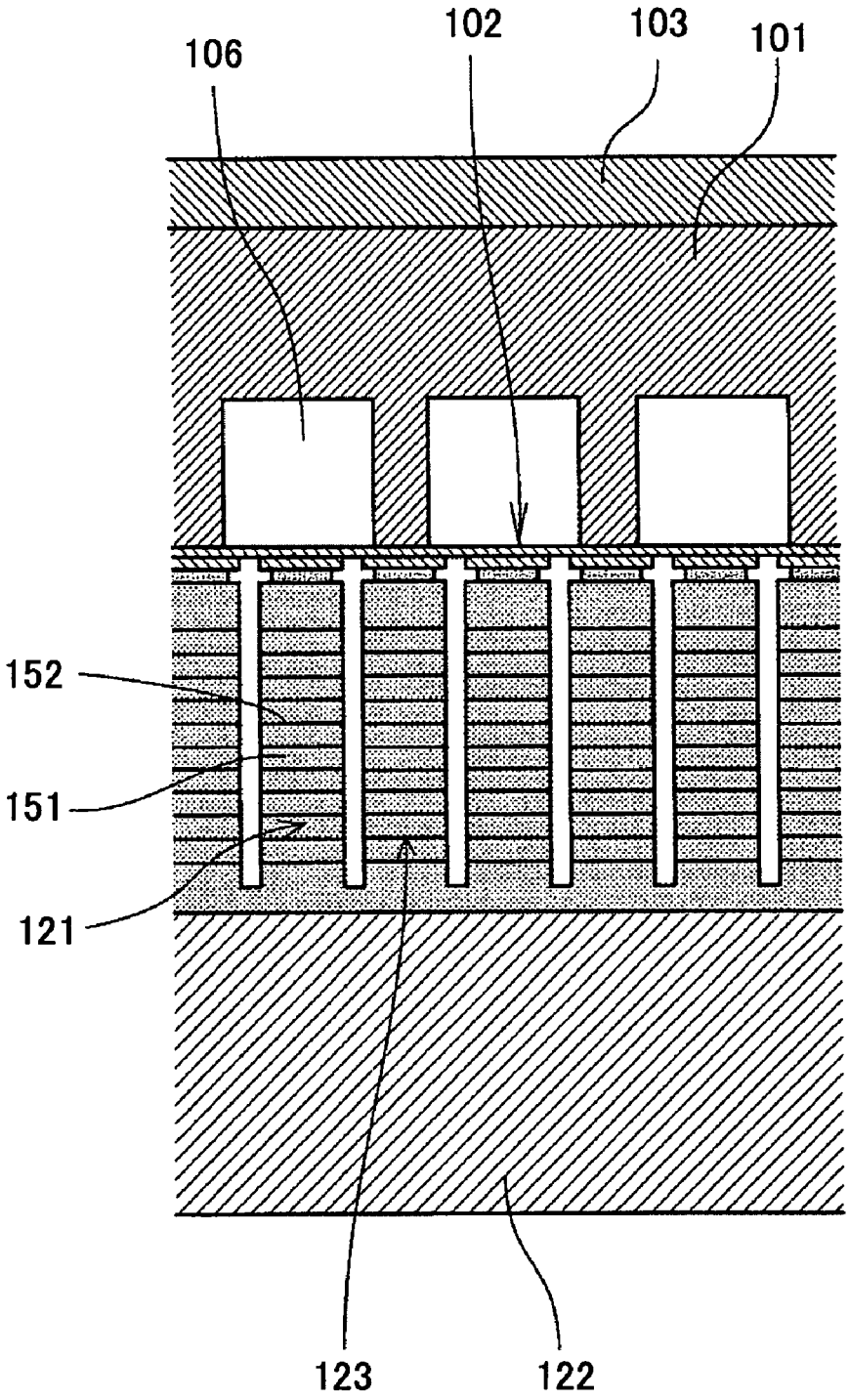
FIG. 5 is a cross-section diagram illustrating the head along the lateral directions of the liquid chamber.

Next, one example of a liquid ejecting head constituting a recording head of the image forming apparatus is described with reference to FIG. 4 and FIG. 5. Additionally, FIG. 4 is a cross-section diagram illustrating the head along the longitudinal directions of a liquid chamber and FIG. 5 is a cross-section diagram illustrating the head along the lateral directions of the liquid chamber (the directions of sequence of the nozzles).

On the liquid ejecting head, a flow channel plate 101 by for example, anisotropically etching a single crystal silicon substrate, a vibrating plate 102 formed by, for example, nickel-electro forming and jointed to the bottom face of the flow channel plate 101, and a nozzle plate 103 jointed to the top face of the flow channel plate 101 are jointed and stacked, thereby forming, for example, a nozzle communicating channel 105 communicating with a nozzle 104 for ejecting a liquid drop (ink drop), a liquid chamber 106, and an ink supply opening 109 communicating with a common liquid chamber 108 for supplying ink into the liquid chamber 106.

Figure 6:
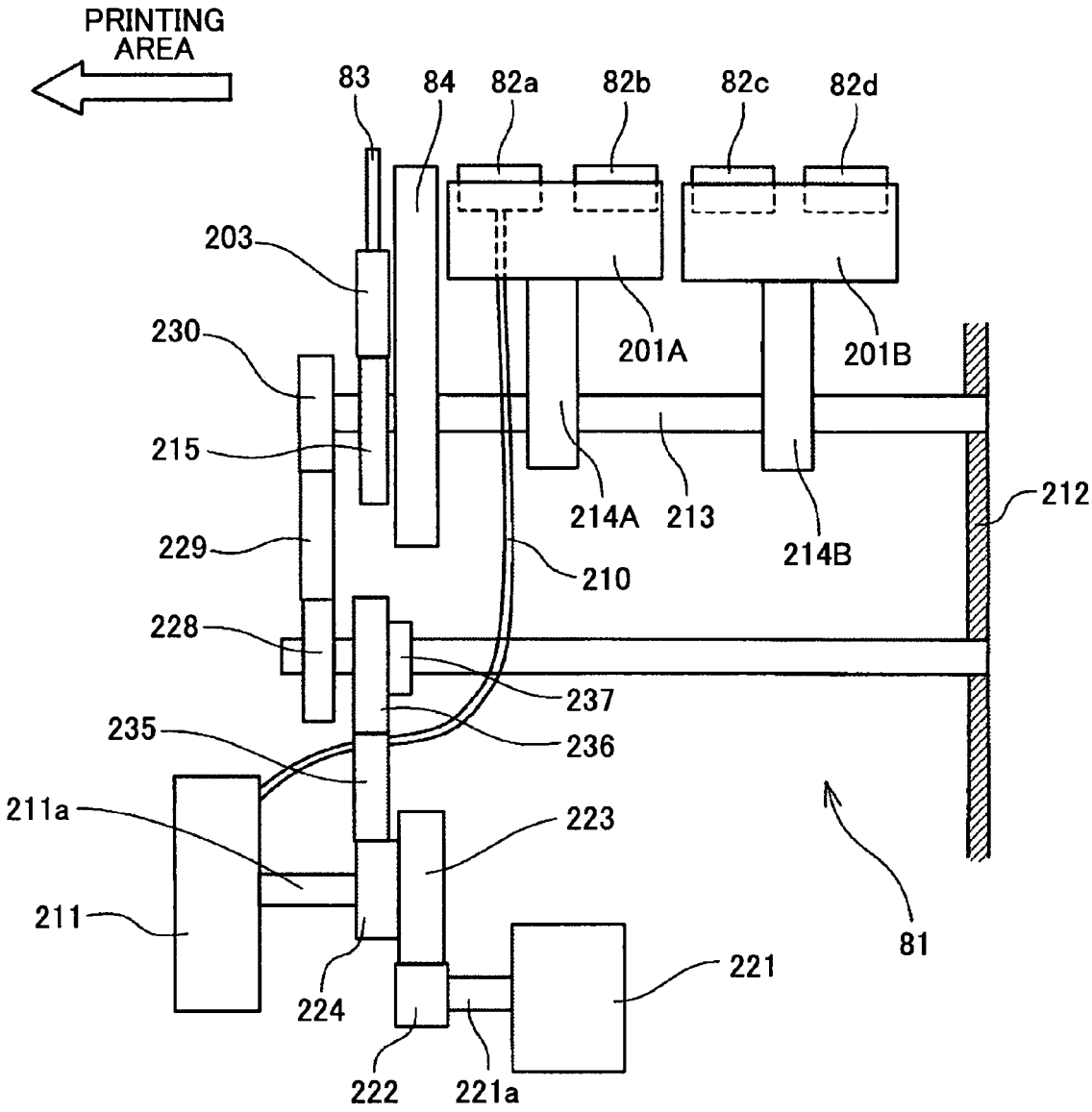
FIG. 6 is a schematic development diagram illustrating a maintenance or recovery mechanism of the image forming apparatus.

Also, two lines of stacked-layer type piezoelectric elements 121 (only one line is shown in FIG. 6) as electromechanical conversion elements which are pressure generation devices (actuator devices) for pressurizing ink in the liquid chamber 106 by deforming the vibrating plate 102, and a base substrate 122 for jointing and fixing the piezoelectric element 121 are provided. Additionally, a columnar support part 123 is provided between the piezoelectric elements 121. The columnar support part 123 is simultaneously formed with the piezoelectric elements 121 by a process of dividing the material of the piezoelectric elements, and however, it is a simple columnar support since no driving voltage is applied.

Also, the piezoelectric elements 121 are connected to FPC cables 126 for connecting to a driving circuit (driving IC) which is not shown in the figures.

Then, the peripheral portion of the vibrating plate 102 is jointed to a frame member 130, and concave portions which are a perforation portion 131 for accommodating an actuator unit composed of, for example, the piezoelectric elements 121 and the base substrate 122 and the common liquid chamber 108, and an ink supply hole 132 for supplying ink from the exterior to the common liquid chamber 108 are formed on the frame member 130. The frame part 130 is formed by means of injection molding of, for example, a thermosetting resin such as an epoxy resin or polyphenylene sulphite.

Herein, on the flow channel plate 101, the concave portions and hole portion which are the nozzle communicating channel 105 and the liquid chamber 106 are formed by, for example, anisotropically etching a single crystal silicon substrate with a crystallographic plane direction of (101) with an alkaline etching liquid such as an aqueous solution of potassium hydroxide (KOH), and however, it is not limited to a single crystal silicon substrate but another one such as a stainless substrate and a photosensitive resin can be also used.

The vibrating plate 102 is formed from a metal plate of nickel and produced by, for example, an electro forming method (electrocasting method), and, in addition, another metal plate or a member provided by jointing metal and resin plates can be also used. The piezoelectric elements 121 and the columnar support part 123 are jointed to the vibrating plate 102 by an adhesive material, and further, the frame part 130 is jointed with an adhesive material.

On the nozzle plate 103, which is connected to the flow channel plate 101 by an adhesive material, the nozzle 104 with a diameter of 10-30 μm is formed for each corresponding liquid chamber 106. The nozzle plate 103 is provided by forming a water-repellent layer on the top surface thereof while a required layer is provided on the surface of a nozzle forming part made of a metal member. Herein, the surface of the nozzle plate 103 is the nozzle face 31*a* described above.

The piezoelectric element 121 is a stacked-layer-type piezoelectric element (herein, a PZT) in which piezoelectric materials 151 and internal electrodes 152 are stacked alternately. The respective internal electrodes 152 which are alternately drawn to corresponding end surfaces of the piezoelectric element 121 are connected to a separate electrode 153 or a common electrode 154. Additionally, in this embodiment, there is provided a configuration such that ink in the liquid chamber 106 is pressurized by using a displacement in the piezoelectric element 121 in a direction of d33 as a piezoelectric direction thereof, and however, there may also be provided a configuration such that ink in the liquid chamber 106 is pressurized by using a displacement in the piezoelectric element 121 in a direction of d31 as a piezoelectric direction thereof. Also, there is also provided a structure such that one column of the piezoelectric elements 121 is provided on one substrate 122.

In thus configured liquid ejecting head, for example, the piezoelectric element 121 contracts and the vibrating plate 102 moves down by lowering a voltage applied to the piezoelectric element 121 than a reference voltage, so that the volume of the liquid chamber 106 is increased and ink flows into the liquid chamber 106. Subsequently, the piezoelectric element 102 is stretched in the layer stacking directions by raising the voltage applied to the piezoelectric element 121 and the vibrating plate 102 is deformed toward the nozzle 104, so as to reduce the volume of the liquid chamber 106. As a result, recording liquid in the liquid chamber 106 is pressurized and a drop of the recording liquid is ejected (or jetted) from the nozzle 104.

Then, as the voltage applied to the piezoelectric element 121 is returned to the reference voltage, the vibrating plate 102 returns to the initial position thereof and the liquid chamber 106 expands so as to cause a negative pressure therein. At this time, the recording liquid is charged from the common liquid chamber 108 into the liquid chamber 106. Then, after the vibration of a meniscus face of ink at the nozzle 104 is dampened and the face is stabilized, the transfer to an operation for next ejection of a liquid drop is made.

Additionally, the method for driving this head is not limited to the example described above (pull—push ejection), and pull-ejection or push-ejection may be conducted depending on provided driving waves.

Next, the general configuration of the maintenance or recovery mechanism 81 is described with referring to FIG. 6. Additionally, the figure is a schematic diagram illustrating the maintenance or recovery mechanism in the condition of developing a part of the mechanism.

As described above, a cap holder 201A including a holding mechanism for holding an suction and moisture retention cap 82*a* and a moisture retention cap 82*b*, a cap holder 201B including a holding mechanism for holding a moisture retention cap 82*c* and a moisture retention cap 82*d*, a blade holder 203 for holding a wiper blade 83 which is a blade composed of an elastic body for cleaning (wiping) a nozzle face 31*a* of the recording head 31, and a blank ejection receiver 84 for conducting blank ejection operation (preliminary ejection operation) for ejecting a liquid drop which does not contribute to printing from the recording head 31, are arranged in the maintenance or recovery mechanism 81.

Herein, the suction and moisture retention cap 82*a* which is the closest to the printing area is connected to a tubing pump (suction pump) 211 which is one of suction means via a flexible tube 210. Therefore, when the maintenance or recovery operation for the recording head 31 is conducted, the recording head 31 for which the recovery operation is conducted is selectively moved to a position capable of capping with the cap 82*a*.

Also, a cam shaft 213 which is free-rotatably supported on a frame 212 is arranged below these cap holders 201A and 201B and the cam shaft 213 is provided with the cap cams 214A and 214B for lifting or lowering the cap holders 201A and 201B and a wiper cam 215 for lifting or lowering the blade holder 203.

Then, in order to drive the tubing pump 211 and rotate the cam shaft 213, with the rotation of a motor 221, a pump gear 223 provided on a pump shaft 211*a* of the tubing pump 211 is engaged with a motor gear 222 provided on the motor shaft 221*a*, and further, an intermediate gear 226 with a one-directional clutch 227 is engaged with an intermediate gear 224 united with the pump gear 223 via an intermediate gear 225. Then, a cam gear 230 fixed on the cam shaft 213 is engaged with an intermediate gear 228 which is co-axial with the intermediate gear 226, via an intermediate gear 229.

In the maintenance or recovery mechanism 81, when the motor 221 is rotated in a normal direction, the motor gear 222, the intermediate gear 224, the pump gear 223, and the intermediate gears 225 and 226 are rotated, and when the shaft 211*a* of the tubing pump 211 is rotated, the tubing pump 211 operates so as to suck inside the suction cap 82*a* (this operation is referred to as "in-cap suction" or "head suction") The other gears 228, etc., do not rotate (operate) since their rotations are cut off due to the one-directional clutch 227.

Also, when the motor 221 is rotated in a reverse direction, the one-directional clutch 237 is coupled, and therefore, the rotation of the motor 221 is transmitted to the cam gear 230 via the motor gear 222, the intermediate gear 224, the pump gear 223, and the intermediate gears 225, 226, 228, and 229, so that the cam shaft 213 is rotated. At this time, the tubing pump 211 has a configuration such that it does not operate due to the reverse rotation of the pump shaft 211*a*. Each of the cap cams 214A and 214B and the wiper cam 215 is lifted or lowered at a predetermined timing by the rotation of the cam shaft 213.

Additionally, when the nozzle face 31*a* of the recording head 31 is cleaned, the nozzle face 31*a* is wiped by moving the recording head 31 relative to the wiper blade 83 on the condition that the wiper blade 83 has been lifted.

Figure 7:
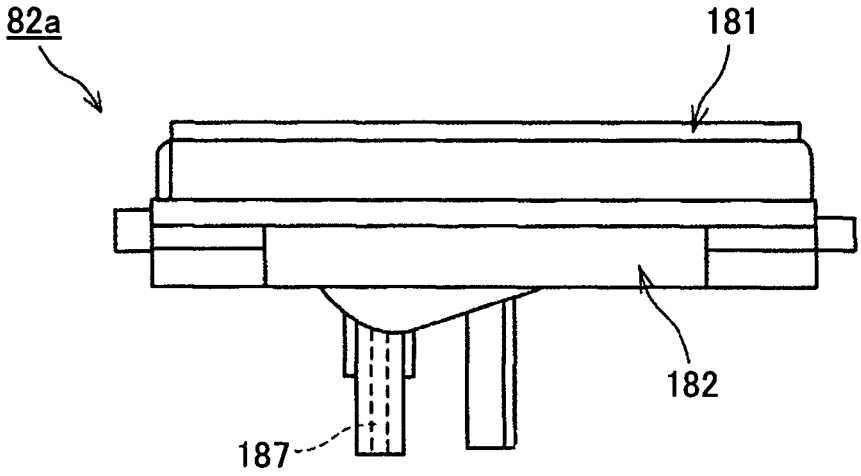
FIG. 7 is an elevation view illustrating a capping member according to the first embodiment of the present invention.
Figure 8:
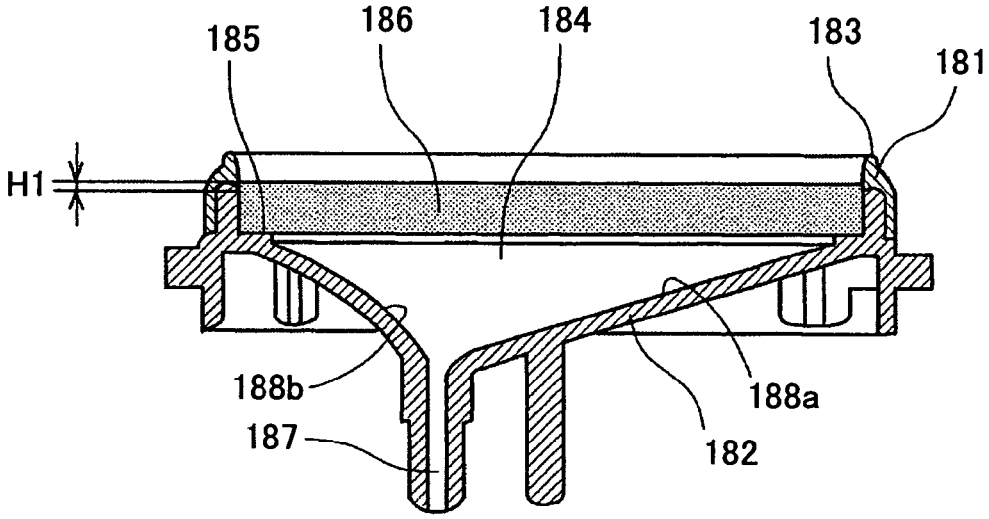
FIG. 8 is a cross-section elevation view illustrating the same.
Figure 9:
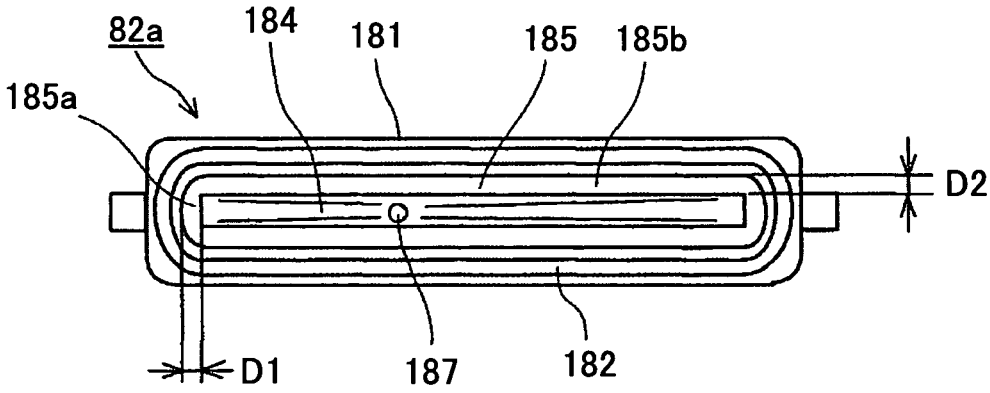
FIG. 9 is a plan view illustrating the same except an absorbing member.
Figure 10A:
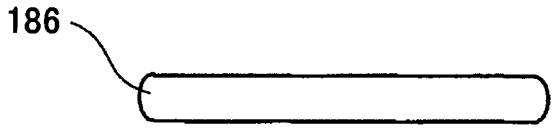
FIGS. 10A and 10B are diagrams illustrating an absorbing member provided on the capping member.
Figure 10B:
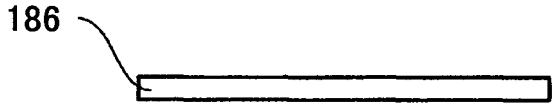

Next, a capping member according to the first embodiment of the present invention, which constitutes the cap 82*a* in the maintenance or recovery mechanism 81, is described with reference to FIGS. 7-10. Herein, FIG. 7 is an elevation view illustrating a capping member according to the embodiment and FIG. 8 is a cross-section elevation view illustrating the same. Also, FIG. 9 is a plan view illustrating the same except an absorbing member and FIGS. 10A and 10B are diagrams illustrating an absorbing member provided on the capping member.

A capping member 180 constituting the cap 82*a* includes a contacting member 181 composed of an elastic member which forms a contact part 183 which contacts an ejection face (nozzle face) 31*a* of the recording head 31, and a recess forming member 182 which forms a recess 184 which forms a closed space with the ejection face 31*a* on the condition that the contact part 183 contacts the ejection face 31*a*, which capping member is formed by integrally molding them by means of two-color injection molding.

Then, a flat part 185 is formed around the recess 184 for the recess forming member 182 and an absorbing member 186 adheres to the flat part 185 with an adhesion member and is arranged to cover the recess 184. In this situation, the absorbing member 186 is fixed on the entire circumference of the flat part 185, for example, by means of an adhesive material (adhesion member).

Also, two inclined faces, that is, a first inclined face 188*a* and a second inclined face 188*b* are formed to the bottom of the recess 184 of the recess forming member 182, which faces incline toward an outlet connected to a tube 210. In this situation, the inclination angle of the first inclined face 188*a* with respect to the horizontal plane is smaller than the inclination angle of the second inclined face 188*b* with respect to the horizontal plane. Then, the inclination angles and a material for forming the recess forming member 182 are selected such that the sum of the inclination angle of the first inclined face 188*a* with respect to the horizontal plane and the contact angle of ink with respect to a member for forming the first inclined face 188*a* (that is, the recess forming member 182 herein) is equal to or greater than 70°.

Thus, since the capping member 180 is provided with the absorbing member 186 for covering the recess 184, the contact part 183 of the capping member 180 contacts the ejection face 31*a* so as to form a closed space and the closed space is provided with a negative pressure by operating the suction pump 211, whereby recording liquid sucked through the nozzle of the recording head 31 is absorbed into the absorbing member 186. Further, liquid absorbed in the absorbing member is disposed of into a waste liquid tank which is not shown in the figures through the recess 184, the outlet 187, and the suction tube 210.

In this case, the cap 180 has a long shape in alignment directions of the nozzles 104 of the recording head 31 (along a direction of sending a paper sheet, herein) and the recording liquid can be ejected from the equally long and thin absorbing member 186 even for one suction hole (outlet 187) since it is absorbed into the absorbing member 186. Consequently, no recording liquid remains in the cap 82*a* and defective ejection can be reduced which is caused by the residual of thickened recording liquid and moisture absorption.

Herein, the mechanism of moisture absorption which is caused by remaining recording liquid in the cap is described with reference to FIG. 21.

At the time of the head recovery operation of the maintenance or recovery mechanism 81, the nozzle face 31*a* of the recording head 31 is capped with the suction cap 82*a* so as to suck and eject ink from the nozzle 104 as described above, and subsequently, the surface of the nozzle face 31*a* is wiped and cleaned by the wiper blade 83 so as to scrape off the contamination thereon together with ejected ink.

Although ink which is ejected into the suction cap 82*a* by means of the recovery operation is ejected by the suction due to the suction pump 211, not all ink can be removed from the suction cap 82*a*, and therefore, a small amount of ink remains in the cap 82*a*. However, as such an operation is repeated, ink remaining in the cap 82 is gradually increased.

Figure 21A:
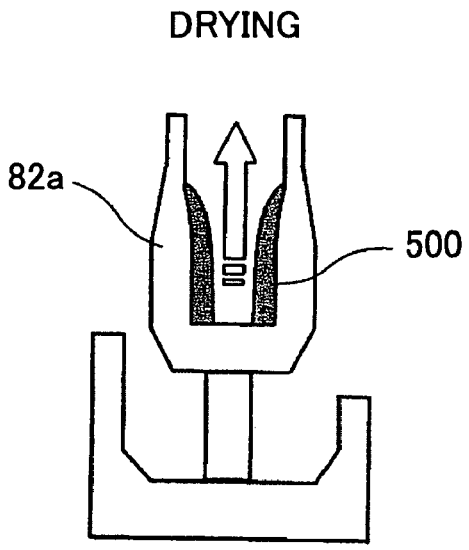
FIGS. 21A and 21B are schematic diagrams which illustrate the moisture absorption function of ink remaining in a cap.
Figure 21B:
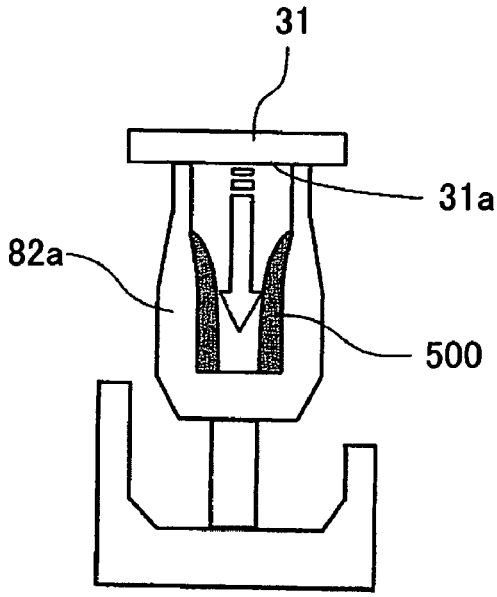

Consequently, as shown in FIG. 21A, ink 500 remaining in the suction cap 82*a* is gradually dried, and as shown in FIG. 21B, when the nozzle face 31*a* of the recording head 31 is left to stand on a condition that it is capped with the suction cap 82*a* to which the dried remaining ink 500 adheres, an moisture absorption is caused such that the dried remaining ink 500 absorbs the water content from the ink in the nozzle 104 of the recording head 31, and the ink in the nozzle 105 is moisture-absorbed and thickened.

When a thickened ink is thus made in the nozzle 104 of the recording head 31, the ejection direction is curved at the time of liquid drop ejection or ejection failure is caused, thereby causing the deterioration of printing quality.

On the other hand, when the absorbing member 186 is arranged in the capping member 180 as in the embodiment, recording liquid is once absorbed in the absorbing member 186 and the recording liquid absorbed in the absorbing member 186 is sucked and ejected. As a result, the increase of the recording liquid remaining in the capping member 180 can be suppressed and the moisture absorption of the recording liquid in the nozzle, which is caused by thickening the remaining recording liquid, can be reduced.

Therefore, since the head maintenance or recovery mechanism (apparatus) having the capping member is provided to a liquid drop ejecting device or an image forming apparatus, the generation of defective ejection which is caused by liquid remaining in the capping member can be prevented son as to conduct stable drop ejection or the generation of defective ejection which is caused by liquid remaining in the capping member can be prevented son as to conduct stable drop ejection and to conduct stable image formation.

Also, as described above, no gap is formed between the absorbing member 186 and the recess forming member 182 in the capping member 82*a* by providing the recess forming member 182 with the flat part 185, bonding the absorbing member 186 to the flat part 185 using via an adhesion member, and fixing the absorbing member 186 on the flat part 185, and therefore, recording liquid can be ejected from the absorbing member 186 more equally. That is, if there is a gap between the body part of the cap 82*a* and the flat part 185, a suction pressure is applied to it at the time of suction, and consequently, recording liquid remains in the absorbing member 186.

In this case, when the absorbing member 186 is fixed on the entire circumference of the flat part 185 and when suction from the capping member 180 is made, no air stream is generated at the peripheral portion of the absorbing member 186 and recording liquid can be sucked from the whole of the absorbing member 186, since the peripheral portion of the absorbing member 186 is fixed on the entire circumference. Accordingly, the suction of recording liquid is sufficiently conducted at the peripheral portion of the absorbing member 186 or even in an area of the absorbing member away from the suction port (outlet) 187 and recording liquid can be surely prevented from fixing and depositing the area.

Also, it is preferable that the width D1 of the flat part in the longitudinal directions of the cap 82*a* be formed so as to be not greater than 3 mm (see FIG. 9.). That is, parts of the flat part 185 of the cap 82*a* with a long shape at which part the both ends 185*a* of the cap in the longitudinal directions are positioned (see FIG. 9.) are parts at which suction is relatively difficult, since they are at the most distant positions when suction is made from the outlet (suction hole) 187. Herein, when the width of the flat part at the both ends of the cap in the longitudinal directions thereof is reduced, the suction of recording liquid absorbed in the absorbing member 186 is surely conducted and the deposition thereof at the both ends can be prevented. Therefore, it is also preferable that the above-mentioned width D1 of both ends 185*a* of the cap in the longitudinal directions thereof is formed so as to be relatively smaller than the width D2 of both ends 185*b* of the cap in the minor directions thereof (directions orthogonal to the longitudinal directions thereof) in the flat part 185 for fixing the absorbing member 186.

Also, it is preferable that the top face of the absorbing member 186 is positioned above the border between the contacting member 181 and the recess forming member 182 at the side of the inner face of the cap. For example, as shown in FIG. 8, the top face of the absorbing member 186 is positioned above the border by a height H. Since the border between the contact part and the recess forming member is thus covered with the absorbing member, recording liquid can be efficiently absorbed which is easy to remain on the border portion after suction. As a result, no thickened recording liquid remains on the cap nip portion and the nozzle recovery can be maintained well. That is, if thickened recording liquid remains on the cap nip portion, the thickened recording liquid is transcribed on the nozzle face at the time of capping. Then, the thickened recording liquid may be spread at the time of cleaning or wiping, and in a worst-case, nozzle may be filled so as to cause ejection failure. However, such a problem can be solved.

Next, the pore size of the absorbing member 186 and the characteristic of election of recording liquid absorbed in the absorbing member 186 are described with reference to FIG. 11.

The swelling rates of the absorbing members with pore sizes different from each other were studied by dipping them in a pigment-based ink as described below. Herein, the swelling rate is defined as the rate of a surface area of an absorbing member after dipping in ink to a surface area of the absorbing member before the dipping. The results are shown in FIG. 11.

Figure 11:
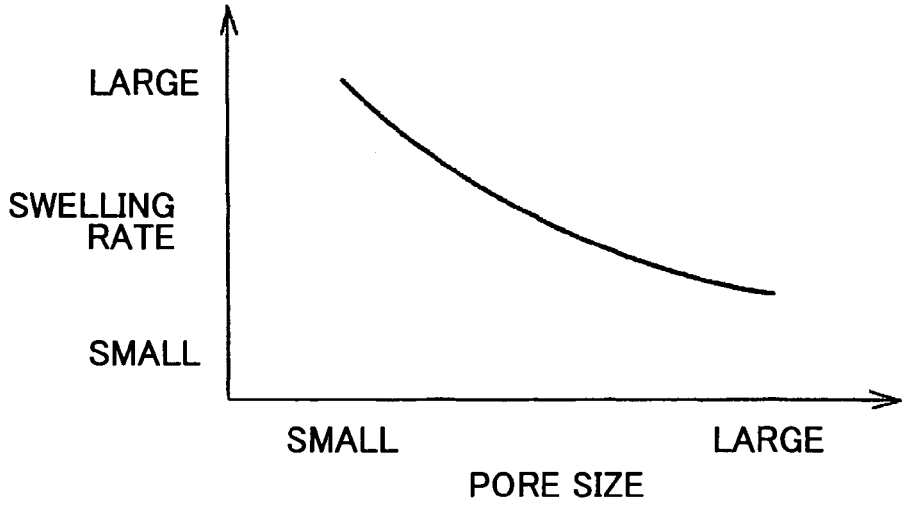
FIG. 11 is a schematic diagram showing one example of the measurement result of the pore size and swelling rate of an absorbing member.

As seen in FIG. 11, the swelling of an absorbing member at the time of ink absorption can be suppressed by increasing the pore size thereof. When the absorbing member is swelled, the pore size thereof becomes relatively small and it becomes easier for ink to remain in the absorbing member. Accordingly, it becomes important to suppress the swelling of the absorbing member. Therefore, the recording liquid can be ejected more surely from the absorbing member 186 by increasing the pore size of the absorbing member so as to the swelling. In the experiments of the inventors, it was confirmed that the swelling of the absorbing member 186 could be suppressed by making the pore size of the absorbing member 186 be equal to or greater than 300 μm when an ink described below was used.

Figure 12:
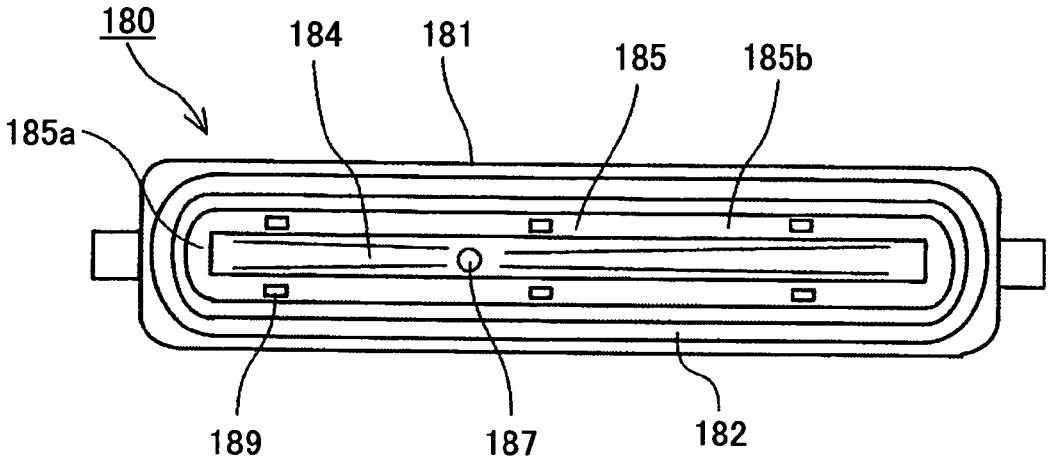
FIG. 12 is a plan view illustrating a capping member according to the second embodiment of the present invention except an absorbing member.

Next, a capping member according to the second embodiment of the present invention is described with reference to FIG. 12. Herein, FIG. 12 is a plan view illustrating the capping member.

Herein, the flat part 185 for binding the absorbing member 186 is provided with plural recesses 189. Thus, when the absorbing member 186 is fixed on the flat part 185 by using an adhesive material, the adhesive material can be prevented from protruding from the flat part 185 so as to reduce the suction area of the absorbing member 186 by forming a recess in the flat part for fixing the absorbing member.

Next, another example of a capping member according to the third embodiment of the present invention is described with reference to FIG. 13 and FIG. 14. Herein, FIG. 13 and FIG. 14 are plan views illustrating the capping member.

Figure 13:
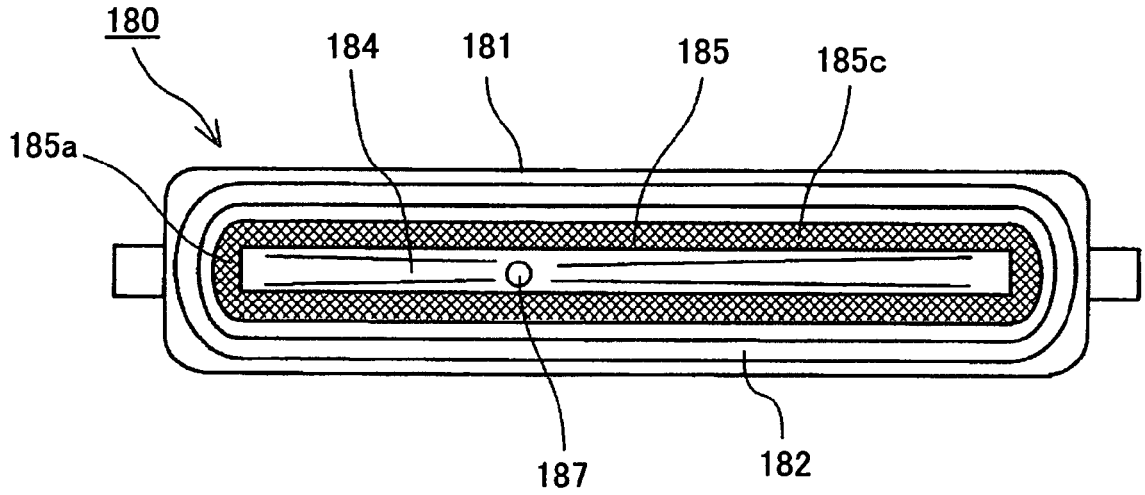
FIG. 13 is a plan view which schematically shows one example of a capping member according to the second embodiment of the present invention.
Figure 14:
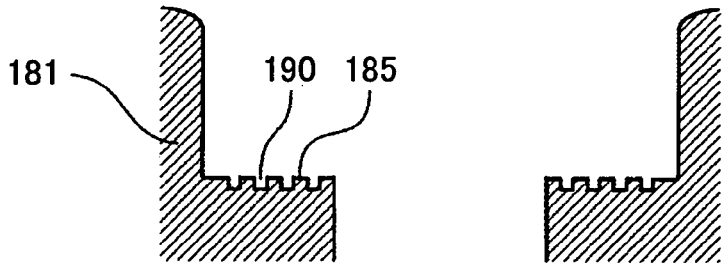
FIG. 14 is an enlarged cross-section diagram which schematically shows the essential part of another example thereof.

Herein, in the example shown in FIG. 13, the surface 185*c* of the flat face 185 for bonding the absorbing member 186 is roughened, for example, by embossing. Also, in example shown in FIG. 14, a fine-concavoconvex face 190 is formed on the surface of the flat face 185, which is roughened consequently.

Thus, when the absorbing member is applied on the capping member, for example, by using an adhesive material, the surface area of the adhesion face is increased so as to improve the adhesion strength by increasing the surface roughness of the (by roughening) flat part surrounding the recess.

Figure 15:
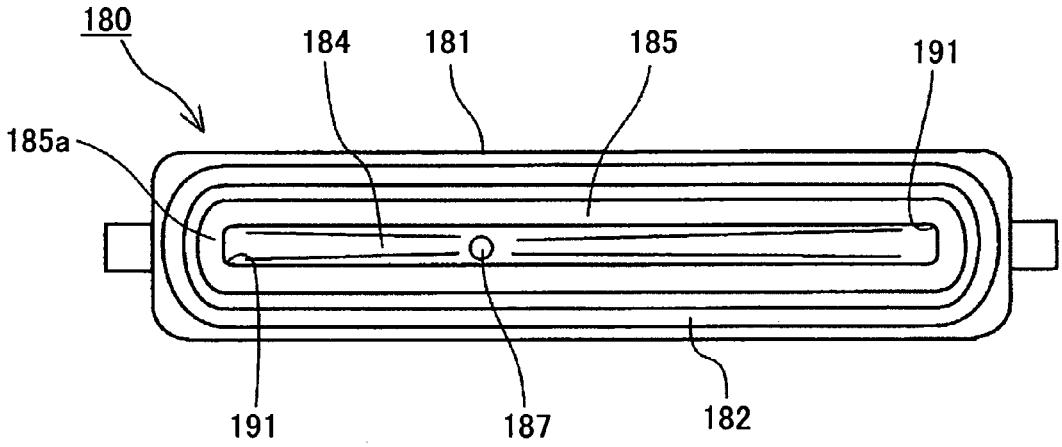
FIG. 15 is a plan view illustrating a capping member according to the third embodiment of the present invention except an absorbing member.

Next, a capping member according to the fourth embodiment of the present invention is described with reference to FIG. 15. Herein, FIG. 15 is a plan view illustrating the capping member.

Herein, the corner portions 191 on the inside perimeter of the flat part 185 is formed in a curved shape such as an R shape. That is, the inside perimeter of the flat part 185 formed around the recess 184 is formed in a plane and rectangular shape and the corner portions 191 are formed in an R shape.

Such a configuration increases the bonding surface area of the absorbing member 186 at the corner portions 191 of the flat part 185 so as to improve the bonding strength of the absorbing member when the absorbing member 186 is bonded to the flat part 185. Also, when the corner portions 191 of the flat part 185 has an R shape, a suction pressure can be prevented from concentrating at the corner portion at the time of suction from the capping member 180 and peeling of the absorbing member can be prevented which is caused by pressure concentration.

Figure 16:
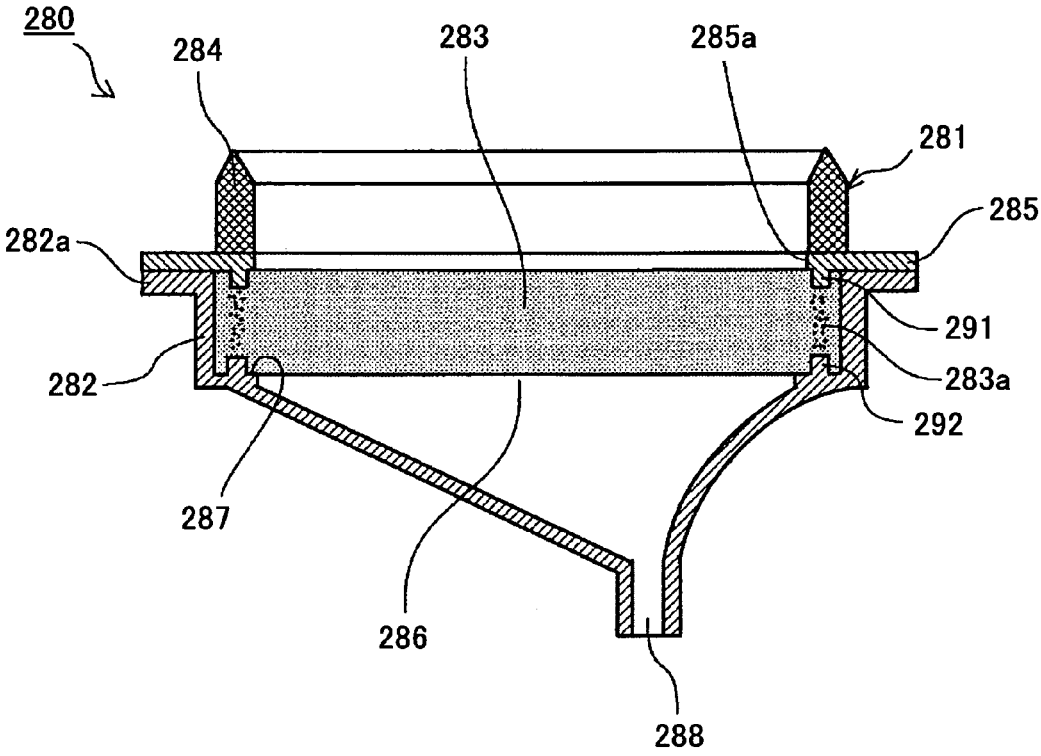
FIG. 16 is a cross-section diagram illustrating a capping member according to the fourth embodiment of the present invention.
Figure 17:
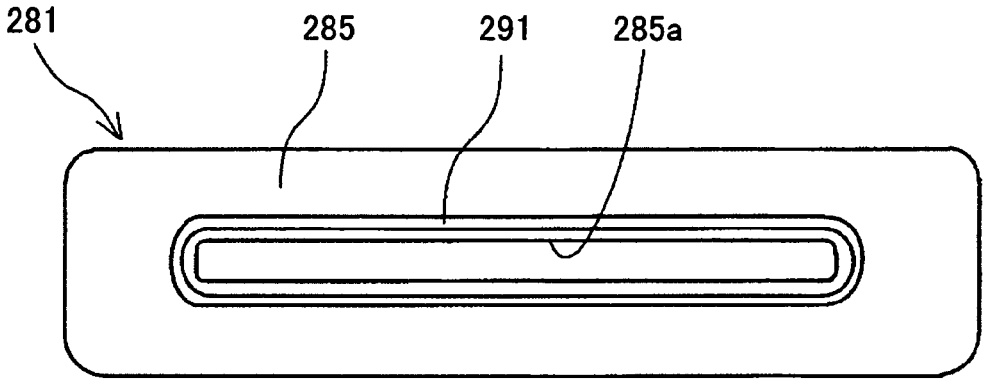
FIG. 17 is a bottom view illustrating a first member of the capping member.
Figure 18:
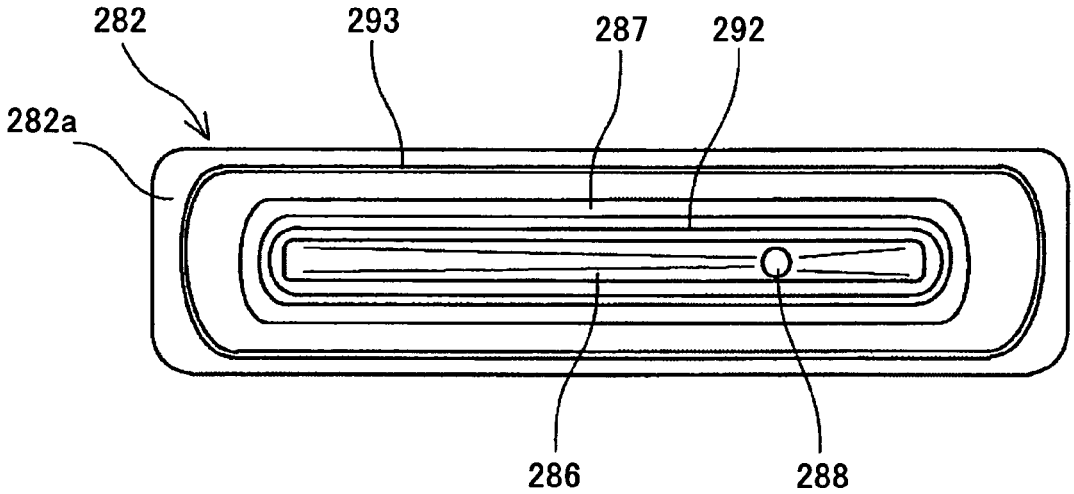
FIG. 18 is a plan view illustrating a second member of the capping member.
Figure 19:
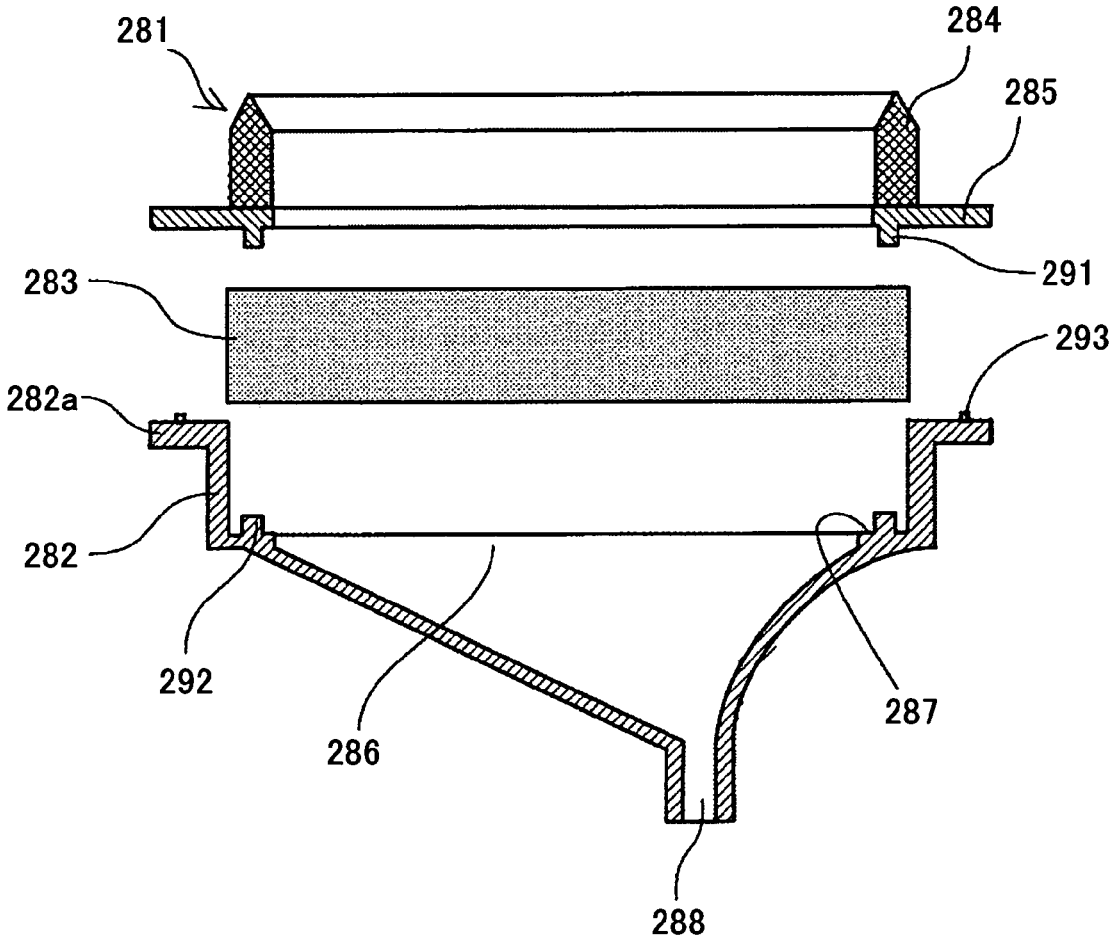
FIG. 19 is a cross-section diagram which schematically shows the condition of the capping member before the assembly thereof.

Next, a capping member according to the fifth embodiment of the present invention is described with reference to FIG. 16 and FIG. 19. Herein, FIG. 16 is a cross-section diagram illustrating the capping member and FIG. 17 is a bottom view of a first member of the capping member. FIG. 18 is a plan view illustrating a second member of the capping member and FIG. 19 is a cross section diagram illustrating the condition of the capping member before the assembly thereof.

The capping member 280 is configured by integrating a first member 281 and second member 282 by, for example, welding, while an absorbing member 283 is intervened therebetween.

The first member 281 is formed by integrating a contact part 284 made of an elastic member contacting the ejection face (nozzle face) 31*a* of the recording head 31 and a holding part 285 for fixing the absorbing member 283, and an aperture portion 285*a* is formed on the holding part 285. The second member 282 is a member for forming a recess 286 for forming a closed space together with the ejection face 31*a* on the condition that the contact part 285 of the first member 281 contacts the ejection face 31*a*, wherein a flat part 287 for fixing the absorbing member 283 is provided around the recess 286 and an outlet 288 which opens in regard to the recess 286 is formed on the bottom portion.

Also, convex portions (ribs) 291 and 292 as pressurizing parts for pressurizing the absorbing member 283 are formed on the entire circumference of the face of the holding part 285 of the first member 281 at the side of the second member 282 and the entire circumference of the surface of the flat part 287 of the second member 282, respectively, such that the portions oppose to each other. Additionally, only one of the ribs 291 and 292 may be provided. Also, a fine rib 293 for improving the welding property thereof with the holding part 285 of the first member is formed on a face of a flange part 282*a* of the second member 282 which face opposes the first member 281.

In thus configured capping member 280, as shown in FIG. 19, the absorbing member 283 is accommodated in the recess 286 of the second member 282 and the second member 282 is covered with the first member 281. Then, the holding part 285 of the first member 281 and the flange part 282*a* of the second member 282 are welded on the condition that they are coupled. The welding can be conducted by, for example, ultrasonic welding, and sure welding can be conducted since the fine rib 293 is formed on the flange part 282*a* of the second member 282.

Accordingly, as shown in FIG. 16, the absorbing member 283 whose circumference is supported (held) by the flat part 287 of the second member 282 is intervened between the rib 291 of the first member 281 and the rib 292 of the second member 282 and fixed by means of a pressing (pressurizing) force.

Thus, due to a configuration such that the first member having the contact part and the second member having the recess and the flat part are included and the absorbing member provided on the flat part is intervened and fixed between the first member and the second member, the absorbing member can be fixed and arranged in the capping member even if no adhesive material is used, so that the assembling processes can be simplified. Then, the circumference of the absorbing member can be pressed and fixed in regard to the entire circumference of the absorbing member, thereby obtaining a function and effect similar to those in the case where the entire circumference of the absorbing member is fixed by means of the adhesion described above.

Also, as in the embodiment described above, at least one of the first member and second member is provided with a rib (which means a convex portion) for pressing the absorbing member, whereby the ejection property of recording liquid from the absorbing member is improved. That is, in the embodiment described above, since a part 283*a* of the absorbing member 283 pressed by the ribs 291 and 292 becomes a locally dense condition due to the collapse of its suction pore (air cavity), it becomes easier to hold recording liquid absorbed in the absorbing member 283 by the dense part 283*a* due to the capillary phenomenon. Accordingly, when suction is made from the outlet 288 in the capping member 280, it is difficulty to generate air stream from the part 283*a*. Therefore, when the ribs 291 and 292 are provided on the entire circumference of the absorbing member 283, it becomes easier to suck and eject recording liquid from the whole of the absorbing member 283.

Figure 20:
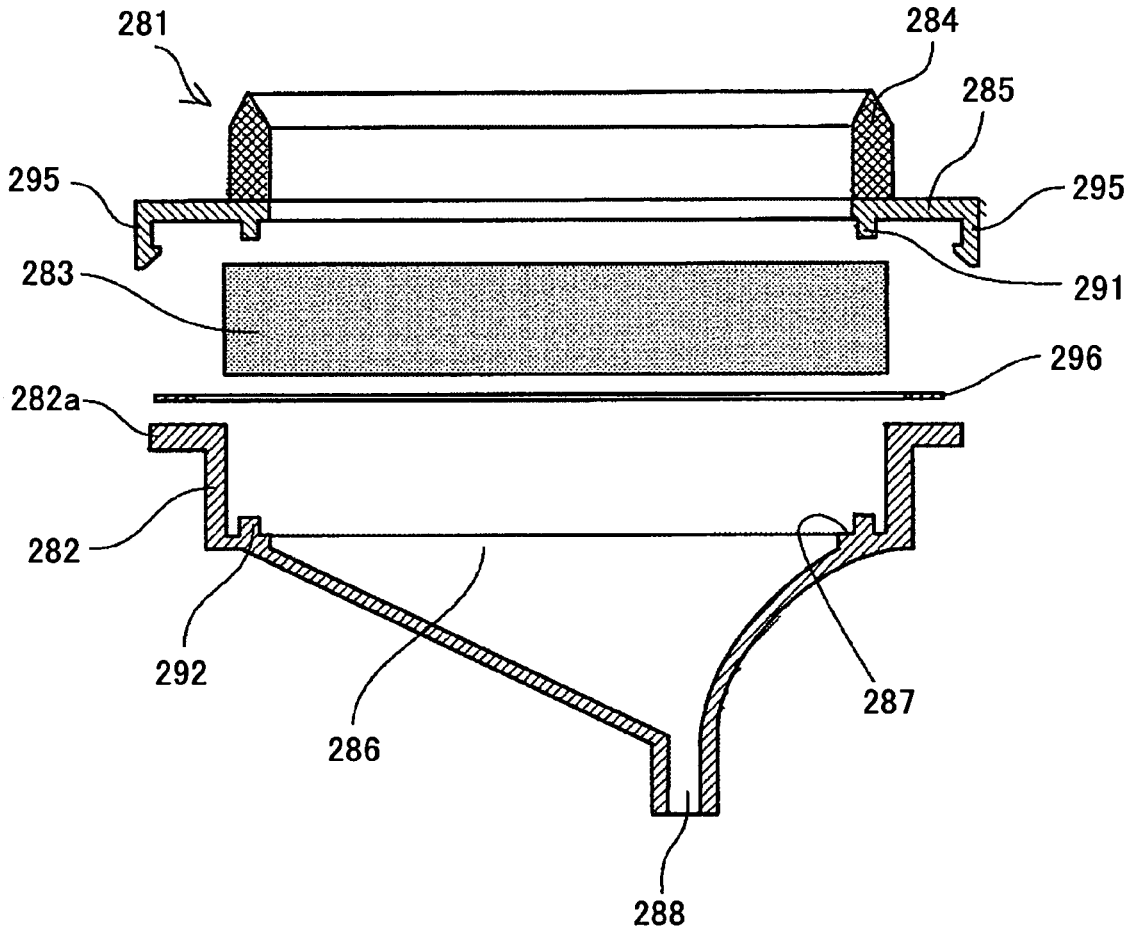
FIG. 20 is a cross-section diagram which schematically shows the condition of a capping member according to the fifth embodiment of the present invention before the assembly thereof.

Next, a capping member according to the sixth embodiment of the present invention is described with reference to FIG. 20. Herein, FIG. 20 is a cross-section diagram illustrating the capping member before the assembly thereof.

Herein, engaging claw portions for engaging the circumference of the flange part 282*a* of the second member 282 are provided on the entire or a part of the circumference of the holding part 285 of the first member 281, and the holding part 285 of the first member 281 and the flange part 282*a* of the second member 282 are fixed by intervening a sealing member 296 therebetween. Thus, for example, a welding process can be omitted.

Next, a recording liquid (referred to as an "ink" herein) used in the image forming apparatus is described.

An ink used in the apparatus according to the embodiments of the present invention contains, at least, water, a coloring agent and a wetting agent, and may further contain a penetrating agent, a surfactant and another component according to need.

Herein, the surface tension of the ink at 25° C. is 15-40 mN/m, and preferably 20-35 mN/m. If it is less than 15 mN/m, a nozzle plate (nozzle board) of the liquid ejecting head is wetted excessively, so that it may be difficult to attain the formation of an ink drop (particle), bleeding on a paper sheet may become significant, and it may be difficult to attain stable ejection of ink. On the other hand, if it is greater than 40 mN/m, the no sufficient penetration of ink into a paper sheet may be caused and the occurrence of beading or a prolonged drying time may be caused.

The surface tension can be measured at 25° C. by using, for example, a surface tensiometer (CBVP-Z available from Kyowa Interface Science Co., Ltd.) and a platinum plate.

—Coloring Agents—

As a coloring agent contained in ink, it is preferable to use at least one of pigments, dyes and colored fine particles.

As a colored fine particle, an aqueous dispersion of polymer fine particles, which contains a coloring material being at lease one of pigments and dyes, are preferably used.

Herein, the phrase "containing a coloring material" means either or both of a condition such that a coloring material is included in a polymer fine particle and a condition such that a coloring material is adsorbed on the surface of a polymer fine particle. In this case, all the coloring material compounded in an ink in the embodiments of the present invention is not necessarily included in or adsorbed on the polymer fine particle, and the coloring material may be dispersed in emulsion. The coloring material is not particularly limited as long as the coloring material is water-insoluble or difficult to dissolve in water and can be adsorbed on the polymer, and can be appropriately selected according to the intent.

Also, the term or phrase "water-insoluble or difficult to dissolve in water" means that 10 parts by mass or greater of a coloring material is not dissolved in 100 parts by mass of water at 20° C. Further, the term "dissolve" means that no separation or precipitation of a coloring material is found on the surface layer or bottom layer of an aqueous solution at visual observation.

Also, the volume-average particle diameter of polymer fine particles (colored fine particles) containing a coloring material is preferably 0.01-0.16 μm in an ink.

As a coloring agent, for example, dyes such as water-soluble dyes, oil-soluble dyes, and dispersed dyes and pigments can be provided. Oil-soluble dyes and dispersed dyes are preferable from the viewpoints of good adsorption and inclusion property thereof, and however, pigments are preferably used from the viewpoint of the light fastness of an obtained image.

Additionally, it is preferable that 2 g/liter or more of each of the dyes can be dissolved in an organic solvent, for example, a ketone-type solvent from the viewpoint of efficient penetration thereof into a polymer fine particle, and it is more preferable that 20-600 g/liter thereof is dissolved.

As a water-soluble dye, dyes classified in acidic dyes, direct dyes, basic dyes, reactive dyes and food colors in color indices and, preferably, being excellent in water resistance and light fastness are used.

Herein, as an acidic dye or a food color, there can be provided, for example, C.I. acid yellows 17, 23, 42, 44, 79, and 142; C.I. acid reds 1, 8, 13, 14, 18, 26, 27, 35, 37, 42, 52, 82, 87, 89, 92, 97, 106, 111, 114, 115, 134, 186, 249, 254, and 289; C.I. acid blues 9, 29, 45, 92, and 249; C.I. acid blacks 1, 2, 7, 24, 26, and 94; C.I. food yellows 3 and 4; C.I. food reds 7, 9, and 14; and C.I. food blacks 1 and 2.

Also, as a direct dye, there can be provided, for example, C.I. direct yellows 1, 12, 24, 26, 33, 44, 50, 86, 120, 132, 142, and 144; C.I. direct reds 1, 4, 9, 13, 17, 20, 28, 31, 39, 80, 81, 83, 89, 225, and 227; C.I. direct oranges 26, 29, 62, and 102; C.I. direct blues 1, 2, 6, 15, 22, 25, 71, 76, 79, 86, 87, 90, 98, 163, 165, 199, and 202; and C.I. direct blacks 19, 22, 32, 38, 51, 56, 71, 74, 75, 77, 154, 168, and 171.

Also, as a basic dye, there can be provided, for example, C.I. basic yellows 1, 2, 11, 13, 14, 15, 19, 21, 23, 24, 25, 28, 29, 32, 36, 40, 41, 45, 49, 51, 53, 63, 64, 65, 67, 70, 73, 77, 87, and 91; C.I. basic reds 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, and 112; C.I. basic blues 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, and 155; and C.I. basic blacks 2 and 8.

Also, as a reactive dye, there can be provided, for example, C.I. reactive blacks 3, 4, 7, 11, 12, and 17; C.I. reactive yellows 1, 5, 11, 13, 14, 20, 21, 22, 25, 40, 47, 51, 55, 65, and 67; C.I. reactive reds 1, 14, 17, 25, 26, 32, 37, 44, 46, 55, 60, 66, 74, 79, 96, and 97; and C.I. reactive blues 1, 2, 7, 14, 15, 23, 32, 35, 38, 41, 63, 80, and 95.

The pigment described above is not particularly limited and can be appropriately selected according to the intent. For example, either an inorganic pigment or an organic pigment can be used.

As an inorganic pigment, there can be provided, for example, titanium oxide, iron oxide, calcium carbonate, barium sulfate, aluminum hydroxide, barium yellow, cadmium red, chrome yellow, and carbon blacks.

Among these, for example, carbon blacks are preferable. Additionally, as a carbon black as described above, there can be provided, for example, ones manufactured by a publicly known method such as a contact method, a furnace method and a thermal method.

Also, as an organic pigment, there can be provided, for example, azoic pigments, polycyclic pigments, dye chelats, nitro pigments, nitroso pigments, and aniline black. Among these, for example, azoic pigments and polycyclic pigments are more preferable. Additionally, as an azoic pigment as described above, there can be provided, for example, azolakes, insoluble azoic pigments, condensed azoic pigments, and chelate azoic pigments. As a polycyclic pigment as described above, there can be provided, for example, phthalocyanine pigments, perylene pigments, perynone pigments, anthraquinone pigments, quinacridone pigments, dioxazine pigments, indigo pigments, thioindigo pigments, isoindolinone pigments, and quinofuralone pigments. As a dye chelate as described above, there can be provided, for example, basic dye-type chelates and acidic dye-type chelates.

The color of a pigment is not particularly limited and can be appropriately selected according to the intent. For example, ones for black or colors can be provided. This may be a single kind or may be used in combination of two or more kinds.

As a black one, there can be provided, for example, carbon blacks (C.I. pigment black 7) such as furnace black, lamp black, acetylene black and channel black, metals such as copper, iron (C.I. pigment black 11) and titanium oxide, and organic pigments such as aniline black (C.I. pigment black 1).

For color ones, as for a yellow ink, there can be provided, for example, CI pigment yellows 1 (fast yellow G), 3, 12 (disazo yellow AAA), 13, 14, 17, 23, 24, 34, 35, 37, 42 (yellow iron oxide), 53, 55, 74, 81, 83 (disazo yellow HR), 95, 97, 98, 100, 101, 104, 108, 109, 110, 117, 120, 128, 138, 150, and 153.

For magenta, there can be provided, for example, CI pigment reds 1, 2, 3, 5, 17, 22 (brilliant fast scarlet), 23, 31, 38, 48:2 (permanent red 2B (Ba)), 48:2 (permanent red 2B (Ca)), 48:3 (permanent res 2B (Sr)), 48:4 (permanent red 2B (Mn)), 49:1, 52:2, 53:1, 57:1 (brilliant carmine 6B), 60:1, 63:1, 63:2, 64:1, 81 (rhodamine 6G lake), 83, 88, 92, 101 (red iron oxide), 104, 105, 106, 108 (cadmium red), 112, 114, 122 (dimethyl quinacridone), 123, 146, 149, 166, 168, 170, 172, 177, 178, 179, 185, 190, 193, 209, and 219.

For cyan, there can be provided, for example, CI pigment blues 1, 2, 15 (copper phthalocyanine blue R), 15:1, 15:2, 15:3 (phthalocyanine G), 15:4, 15:6 (phthalocyanine blue E), 16, 17:1, 56, 60 and 63.

Also, for a medium color, as for green or blue, there can be provided, for example, C.I. pigment reds 177, 194 and 224, C.I. pigment orange 43, C.I. pigment violets 3, 19, 23, and 37, and C.I. pigment greens 7 and 36.

As a pigment, a self-dispersion-type pigment is preferable used in which at least one kind of hydrophilic group is bonded to the surface of a pigment directly or via another atomic group and which can be stably dispersed without use of a dispersing agent. As a result, a dispersing agent for dispersing a pigment, as for a conventional ink, is not required. As a self-dispersion-type pigment as described above, ones having an ionicity are preferable, and anionically charged ones and cationically charged ones are preferable.

The volume-average particle diameter of a self-dispersion-type pigment in ink is preferably 0.01-0.16 μm.

Also, as an anionic and hydrophilic group, there can be provided, for example, —COOM, —$SO_3M$, —$PO_3HM$, —$PO_3M_2$, —$SO_2NH_2$, and —$SO_2NHCOR$, in which formulas, M represents a hydrogen atom, an alkali metal, ammonium, or an organic ammonium and R represents an alkyl group having 1-12 carbon atoms, a phenyl group which may have a substituent, or a naphthyl group which may have a substituent. Among these, color pigments with a —COOM or —$SO_3M$ bonding to the surface thereof are preferably used.

For an "M" in the hydrophilic group, as an alkali metal, there can be provided, for example, lithium, sodium and potassium. As an organic ammonium as described above, there can be provided, for example, mono- through tri-methyl ammonium, mono- through tri-ethyl ammonium, and mono- through tri-methanol ammonium. For a method for obtaining an anionically charged color pigment as described above, as a method for introducing —COONa onto the surface of a color pigment, there can be provided, for example, a method for oxidizing a color pigment with sodium hypochlorite, a sulfonation method and a method reacting a diazonium salt.

Also, as a cationic and hydrophilic group, for example, quaternary ammonium groups are preferable and the quaternary ammonium groups described below are more preferable. Then, pigments with any of these bonding to the surface thereof are preferable as a coloring material.

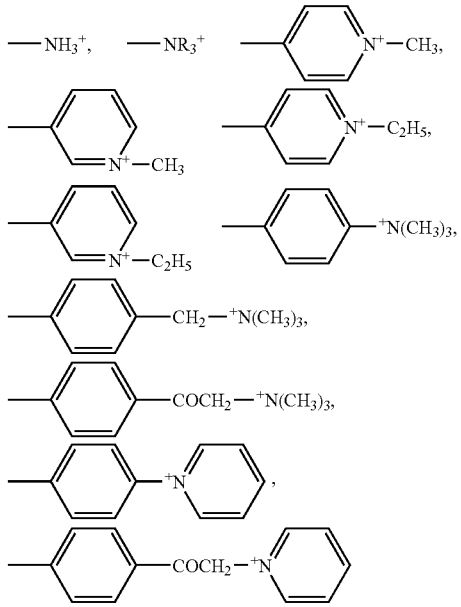

A method for manufacturing a cationic self-dispersion-type carbon black to which the hydrophilic group bonds is not particularly limited and can be appropriately selected according to the intent. For example, as a method bonding an N-ethylpyridyl group represented by the following structural formula, for example, a method for treating carbon black with 3-amino-N-ethylpyridinium bromide can be provided.

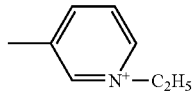

Herein, the hydrophilic group may bond to the surface of carbon black via another atomic group. As another atomic group, there can be provided, for example, an alkyl group having 1-12 carbon atoms, a phenyl group which may have a substituent or a naphthyl group which may have a substituent. As a specific example in the case where the hydrophilic group described above bonds to the surface of carbon black via another atomic group, there can be provided, for example, —C2H4COOM (wherein M represents an alkali metal or a quaternary ammonium), —$PhSO_3M$ (wherein Ph is a phenyl group and M represents an alkali metal or a quaternary ammonium), and a —$C_5H_{10}NH_3^+$.

For an ink used in a recording method according to the embodiments of the present invention, a pigment dispersion liquid may be used for which a pigment dispersing agent is used.

For a pigment dispersing agent, as a hydrophilic polymer compound as described above, there can be provided, for example, plant-derived polymers such as acacia gum, tragacanth gum, guar gum, karaya gum, locust bean gum, arabinogalactan, pectin, quince and seed starch, marine algae-derived polymers such as alginic acid, carageenan, and agar, animal-derived polymers such as gelatin, casein, albumin, and collagen, and micro-organism-derived polymers such as xanthene gum and dextran, with rrespect to natural materials. With respect to semisynthetic materials, there can be provided, for example, fiber element-type polymers such as methylcellulose, ethylcellulose, hydroxyethylcellulose, hydroxypropylcellulose, and carboxymethylcellulose, starch-type polymers such as sodium starch glycolate and sodium starch phosphate (ester), and marine algae-derived polymers such as sodium alginate and propylene glycol alginate. With respect to pure synthetic materials, there can be provided, for example, vinyl-type polymers such as poly(vinyl alcohol), poly(vinyl pyrrolidone), and poly(vinyl methyl ether), acrylic resins such as not-cross-linked poly(acrylamide), poly(acrylic acid) and alkali metal salt thereof, and water-soluble styrene-acrylic resins, water-soluble styrene-maleic acid resin, water-soluble vinylnaphthalene-acrylic resins, poly(vinylpyrrolidone), poly(vinylalcohol), alkali metal salts of β-naphthalnesulfonic acid—formalin condensate, polymer compounds having a salt of cationic functional group such as a quaternary ammonium and an amino group as a side chain thereof, and natural polymer compounds such as shellac. Among these, homopolymers of acrylic acid, methacrylic acid, or styrene-acrylic acid and copolymers of a monomer having another hydrophilic group, which may have an introduced carboxylic group, are particularly preferable as a polymer dispersing agent.

Herein, the weight-average molecular weight of the copolymer is preferably 3,000-50,000, more preferably 5,000-30,000, and further preferably 7,000-15,000.

Also, the mixing mass ratio of a pigment and a dispersing agent (pigment: dispersing agent) is preferably 1:0.06-1:3 and more preferably 1:0.125-1:3.

The amount of the coloring agent added into ink is preferably 6-15% by mass and more preferably 8-12% by mass. If the amount of the added one is less than 6% by mass, image density may be lowered due to the drop of coloring power thereof or feathering or bleeding may be increased due to the drop of the viscosity thereof. If it is greater than 15% by mass, for example, when an ink jet recording apparatus is left to stand, the nozzle thereof may easily dry so that no-ejection-phenomenon may be caused, or the viscosity may become too high so that the penetration property may be lowered. Also, a dot may not extend, so that image density may be lowered or a rough image may be provided.

—Wetting Agents—

The wetting agent is not particularly limited and can be appropriately selected according to the intent. For example, at least one selected from polyol compounds, lactam compounds, urea compounds and saccharides is preferable.

Herein, as a polyol compound, there can be provided, for example, polyhydric alcohols, polyhydric alcohol alkyl ethers, polyhydric alcohol aryl ethers, nitrogen-containing heterocyclic compounds, amides, amines, sulfur-containing compounds, propylene carbonate, and ethylene carbonate. One kind of it may be used singularly or two or more kinds thereof may be in combination.

As a polyhydric alcohol, there can be provided, for example, ethylene glycol, diethylene glycol, triethylene glycol, polyethylene glycol, polypropylene glycol, 1,3-propanediol, 1,3-butanediol, 1,4-butanediol, 3-methyl-1,3-butanediol, 1,3-propanediol, 1,5-pentanediol, 1,6-hexanediol, glycerol, 1,2,6-hexanetriol, 1,2,4-butanetriol, 1,2,3-butanetriol, and petriols.

As a polyhydric alcohol alkyl ethers, there can be provided, for example, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

As a polyhydric alcohol aryl ether, there can be provided, for example, ethylene glycol monophenyl ether and ethylene glycol monobenzyl ether.

As a nitrogen-containing heterocyclic compound, there can be provided, for example, N-methyl-2-pyrrolidone, N-hydroxyethyl-2-pyrrolidone, 2-pyrrolidone, 1,3-dimethylimidazolidinone, and ε-caprolactam.

As an amide, there can be provided, for example, formamide, N-methylformamide, and N,N-dimethylformamide.

As an amine, there can be provided, for example, monoethanolamine, diethanolamine, triethanolamine, monoethylamine, diethylamine, and triethylamine.

As a sulfur-containing compound, for example, dimetyl sulfoxide, sulfolane, and thiodiethanol.

Among these, from the viewpoints of the solubility thereof and of obtaining excellent effect on the prevention of a defective jetting performance caused by water evaporation, preferable are glycerin, ethylene glycol, diethylene glycol, triethylene glycol, propylene glycol, dipropylene glycol, tripropylene glycol, 1,3-butanediol, 2,3-butanediol, 1,4-butanediol, 3-methyl-1,3-butanediol, 1,3-propanediol, 1,5-pentanediol, tetraethylene glycol, 1,6-hexanediol, 2-methyl-2,4-pentanediol, polyethylene glycol, 1,2,4-butanetriol, 1,2,6-hexanetriol, thiodiglycol, 2-pyrrolidone, N-methyl-2-pyrrolidone, and N-hydroxyethyl-2-pyrrolidone.

As a lactam compound as described above, there can be provided, for example, at least one kind selected from 2-pyrrolidone, N-methyl-2-pyrrolidone, N-hydroxyethyl-2-pyrrolidone, and ε-caprolactam.

Also, as a urea compound, there can be provided, for example, at least one kind selected from urea, thiourea, ethylene urea, and 1,3-dimethyl-2-imidazolidinone. Commonly, the amount of the urea added into ink is preferably 0.5-50% by mass and more preferably 1-20% by mass.

Also, as a saccharide, there can be provided monosaccharides, disaccharides, oligosaccharides (including trisaccharides and tetrasaccharides), polysaccharides and derivatives thereof.

Among these, glucose, mannose, fructose, ribose, xylose, arabinose, galactose, maltose, cellobiose, lactose, sucrose, trehalose, and malttriose are preferable and multitose, sorbitose, gluconolactone and maltose are particularly preferable.

The polysaccharides described above means generalized saccharides and can be used to mean that substances widely existing in nature such as α-cyclodextrins and celluloses are included.

As a derivative from saccharides, there can be provided, for example, reduced saccharides (for example, sugar alcohols represented by the general formula: $HOCH_2(CHOH)_nCH_2OH$ (wherein n represents an integer of 2-5), oxidized saccharides (for example, aldonic acids and uronic acids), amino acids, and thio acids. Among these, sugar alcohols are particularly preferable. As an example of the alcohols, maltitol and sorbite are provided.

The content of a wetting agent in ink is preferably 10-50% by mass and more preferably 20-35% by mass. If the content is too small, the nozzle may easily dry and defective ejection of a liquid drop may be caused. If it is too large, the viscosity of ink becomes high and may exceed a proper viscosity range.

—Penetrating Agents—

As a penetrating agent as described above, water-soluble organic solvents such as polyol compounds and glycol ether compounds are used, and particularly, at least, either of a polyol compound with 8 or more carbons and a glycol ether compound is preferably used.

Herein, if the carbon numbers of the polyol compound is less than 8, no sufficient penetrating property may be obtained whereby a recording medium may be contaminated at the time of double-side printing, or the spread of ink on a recording medium is not sufficient and the filling thereof in a picture element is deteriorated, whereby the quality of a character or image density may be lowered.

As a polyol compound with 8 or more carbon atoms, for example, 2-ethyl-1,3-hexanediol (solubility: 4.2% (25° C.)) and 2,2,4-trimethyl-1,3-pentanediol (solubility: 2.0% (25° C.)) are preferable.

The glycol ether compounds are not particularly limited and can be appropriately selected according to the intent. For example, there can be provided polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether, and polyhydric alcohol aryl ethers such as ethylene glycol monophenyl ether and ethylene glycol monobenzyl ether.

Also, the amount of added penetrating agent is not particularly limited and can be appropriately selected according to the intent. Herein, 0.1-20% by mass is preferable and 0.5-10% by mass is more preferable.

—Surfactants—

The surfactant is not particularly limited and can be appropriately selected according to the intent, and for example, there can be provided anionic surfactants, nonionic surfactants, amphoteric surfactants, and fluorine-containing surfactants.

As an anionic surfactant, there can be provided, for example, polyoxyethylene alkyl ether acetates (salts), dodecylbenzenesulfonates (salts), laurylates (salts), and polyoxyethylene alkyl ether sulfates (salts).

As a nonionic surfactant, there can be provided, for example, acetylene glycol-type surfactants, polyoxyethylene alkyl ethers, polyoxyethylene alkylphenyl ethers, polyoxyethylene alkyl esters, and polyoxyethylene sorbitan fatty acid esters.

As an acetylene glycol-type surfactant, there can be provided, for example, 2,4,7,9-tetramethyl-5-decyne-4,7-diol, 3,6-dimethyl-4-octyne-3,6-diol, and 3,5-dimethyl-1-hexyne-3-ol. For the acetylene glycol-type surfactant, there can be provided, for example, Surfynols 104, 82, 465, 485, and TG (available from Air Products and Chemicals, Inc. (U.S.)) as commercial products.

As an amphoteric surfactant, there can be provided, for example, lauryl aminopropionate (salts), lauryl dimethyl betaine, stearyl dimethyl betaine, and lauryl dihydroxyethyl betaine. Specifically, there can be provided, for example, lauryldimethylamineoxide, myristyldimethylamineoxide, stearyldimethylamineoxide, dihydroxyethyllaurylamineoxide, polyoxyethylene coconut oil alkyldimethylamineoxide, dimethylalkyl (coconut) betaine, and dimethyl lauryl betaine.

Among these surfactants, surfactants represented by the following chemical formulas (I), (II), (III), (IV), (V), and (VI) are preferable.

$$R1—O—(CH_2CH_2O)hCH_2COOM \quad (I)$$

Also, in chemical formula (I) described above, R1 represents an alkyl group, and more particularly, an alkyl group with 6-14 carbon atoms which may be branched. h represents an integer of 3-12. M represents one selected from alkali metal ions, quaternary ammonium ions, quaternary phosphonium ions, and alkanolamines.

$$\begin{array}{l} \quad\;\; CH_2COO—R^2 \\ \quad\;\; | \\ MO_3SCHCOO—R^2 \end{array} \quad (II)$$

Also, in chemical formula (II) described above, $R^2$ represents an alkyl group, and more particularly, an alkyl group with 5-16 carbon atoms which may be branched. M represents one selected from alkali metal ions, quaternary ammonium ions, quaternary phosphonium ions, and alkanolamines.

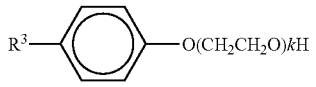

(III)

Herein, in chemical formula (III) described above, $R^3$ represents a hydrocarbon group, for example, an alkyl group with 6-14 carbon atoms which may be branched. k represents an integer of 5-20.

$$R4—(OCH_2CH_2)jOH \quad (IV)$$

Herein, in chemical formula (IV) described above, R4 represents a hydrocarbon group, for example, an alkyl group with 6-14 carbon atoms. j represents an integer of 5-20.

$$\begin{array}{l} \qquad\qquad\qquad\quad CH_3 \\ \qquad\qquad\qquad\quad | \\ H—(OCH_2CH_2)_L—(OCHCH_2)_p—R^6 \end{array} \quad (V)$$

Herein, in chemical formula (V) described above, $R^6$ represents a hydrocarbon group, for example, an alkyl group with 6-14 carbon atoms which may be branched. L and p independently represent integers of 1-20.

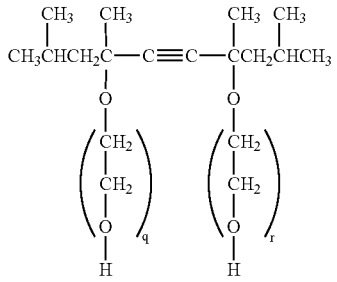

(VI)

Herein, in chemical formula (VI) described above, q and r independently represent integers of 0-40.

The surfactants represented by structural formulas (I) and (II) described above are specifically shown in the form of a free acid, below. First, as a surfactant represented by (I), the following ones represented by (I-1) to (I-6) can be provided.

$$CH_3(CH_2)_{12}O(CH_2CH_2O)_3CH_2COOH \quad (I\text{-}1)$$

$$CH_3(CH_2)_{12}O(CH_2CH_2O)_4CH_2COOH \quad (I\text{-}2)$$

$$CH_3(CH_2)_{12}O(CH_2CH_2O)_5CH_2COOH \quad (I\text{-}3)$$

$$CH_3(CH_2)_{12}O(CH_2CH_2O)_6CH_2COOH \quad (I\text{-}4)$$

$$CH_3(CH_2)_{11}\underset{\underset{CH_3}{|}}{C}HO(CH_2CH_2O)_6CH_2COOH \quad (I\text{-}5)$$

$$CH_3(CH_2)_6\underset{\underset{(CH_2)_5CH_3}{|}}{C}HO(CH_2CH_2O)_3CH_2COOH \quad (I\text{-}6)$$

Next, as a surfactant represented by (II), the following ones represented by (II-1) to (II-4) can be provided.

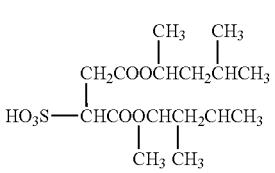

(II-1)

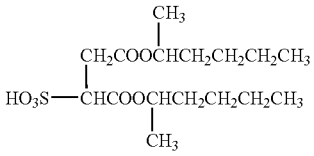

(II-2)

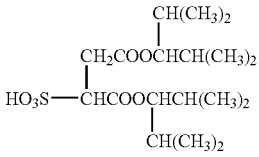

(II-3)

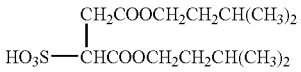

(II-4)

As a fluorine-containing surfactant, one represented by the following general formula (A) is preferable.

$$CF_3CF_2(CF_2CF_2)m—CH_2CH_2O(CH_2CH_2O)nH \quad (A)$$

Herein, in general formula (A) described above, m represents an integer of 0-10. n represents an integer of 1-40.

As a fluorine-containing surfactant, there can be provided, for example, perfluoroalkyl sulfonic acid compounds, perfluoroalkyl carboxylic acid compounds, perfluoroalkyl phosphate (ester) compounds, perfluoroalkyl ethyleneoxide compounds, and polyoxyalkylene ether polymer compounds having a perfluoroalkyl ether group as a side chain. Among these, a polyoxyalkylene ether polymer compounds having a perfluoroalkyl ether group as a side chain has a low foamability and the bioaccumulation potential thereof with respect to a fluorine compound, which is recently considered to be problematic, is low. Therefore, it has high safety, which is particularly preferable.

Herein, as a perfluoroalkyl sulfonic acid compound, there can be provided, for example, perfluoroalkyl sulfonic acids and perfluoroalkyl sulfonates (salts).

Also, as a perfluoroalkyl carboxylic acid compound, there can be provided, for example, perfluoroalkyl carboxylic acids and perfluoroalkyl carboxylates (salts).

Also, as a perfluoroalkyl phosphate (ester) compound, there can be provided, for example, perfluoroalkyl phosphoric acid esters and salts of perfluoroalkyl phosphoric acid esters.

As a polyoxyalkylene ether polymer compounds having a perfluoroalkyl ether group as a side chain, there can be provided, for example, polyoxyalkylene ether polymers having a perfluoroalkyl ether group as a side chain, sulfate ester salts of polyoxyalkylene ether polymers having a perfluoroalkyl ether group as a side chain, and salts of a polyoxyalkylene ether polymers having a perfluoroalkyl ether group as a side chain.

As a counter ion of a salt in these fluorine-containing surfactants, there can be provided, for example, Li, Na, K, $NH_4$, $NH_3CH_2CH_2OH$, $NH_2(CH_2CH_2OH)_2$, and $NH(CH_2CH_2OH)_3$.

The fluorine-containing surfactant may be appropriately synthesized and used or a commercial product may be used.

As a commercial product thereof, there can be provided, for example, Surflons S-111, S-112, S-113, S-121, S-131, S-132, S-141, and S-145 (available from Asahi Glass Co., Ltd.), Fluorads FC-93, FC-95, FC-98, FC-129, FC-135, FC-170C, FC-430, and FC-431 (available from Sumitomo 3M Limited), Megafacs F-470, F1405, and F-474 (available from Dainippon Ink and Chemicals, Incorporated), Zonyls TBS, FSP, FSA, FSN-100, FSN, FSO-100, FSO, FS-300, UR (available from DuPont), FT-110, FT-250, FT-251, FT-400S, FT-150, FT-400SW (available from NEOS Co. Ltd.), and PF-151N (available from Omnova Solutions, Inc.). Among these, Zonyls FSN, FSO-100, and FSO (available from DuPont) are particularly preferable from the viewpoints of high reliability and good color development.

—Other Components—

Other components are not particularly limited and can be appropriately selected according to need, and there can be provided, for example, resin emulsions, pH adjustors, antiseptics or fungicides, rust inhibitors, antioxidants, ultraviolet ray absorbers, oxygen absorbers, and light stabilizers.

—Resin Emulsions—

A resin emulsion is provided by dispersing resin fine particles in water as a continuous phase and may contain a dispersing agent such as a surfactant according to need.

Commonly, the content of resin fine particles as a dispersed phase component (the content of resin fine particles in a resin emulsion) is preferably 10-70% by mass. Also, in regard to the particle diameter of the resin fine particle, the average particle diameter is preferably 10-1,000 nm, and more preferably 20-300 nm, particularly when use in an ink jet recording apparatus is taken into consideration.

The resin fine particle component in the dispersed phase is not particularly limited and can be appropriately selected according to the intent, and there can be provided, for example, acrylic resins, vinyl acetate-type resins, styrene-type resins, butadiene-type resins, styrene-butadiene-type resins, vinyl chloride-type resins, acryl-styrene-type resins, and acryl silicone-type resins. Among these, acryl silicone-type resins are particularly preferable.

The resin emulsion may be appropriately synthesized and used or a commercial product may be used.

As a commercially available resin emulsion, there can be provided, for example, Microgels E-1002 and E-5002 (styrene-acryl-type resin emulsions, available from Nippon Paint Co., Ltd.), VONCOAT 4001 (an acrylic resin emulsion, available from Dainippon Ink and Chemicals, Incorporated), VONCOAT 5454 (a styrene-acryl-type resin emulsion, available from Dainippon Ink and Chemicals, Incorporated), SAE-1014 (a styrene-acryl-type resin emulsion, available from ZEON Corporation), Saibinol SK-200 (an acrylic resin emulsion, available from Saiden Chemical Industry Co., Ltd.), Primals AC-22 and AC-61 (acrylic resin emulsions, available from Rohm and Haas Company), Nanocryls SBCX-2821 and SBCX-3689 (acryl silicone-type resin emulsions, available from Toyo Ink Mfg. Co., Ltd.), and #3070 (a methyl methacrylate polymer resin emulsion, available from Mikuni Color Ltd.).

The content of the added resin fine particle component of a resin emulsion in the ink is preferably 0.1-50% by mass, more preferably 0.5-20% by mass, and further preferably 1-10% by mass. If the content of added one is less than 0.1% by mass, the effect of improving the resistance to clogging and the ejection stability may not be sufficient, and if it is greater than 50% by mass, the preservation stability of the ink may be degraded.

Also, as an antiseptic or fungicide, there can be provided, for example, 1,2-benzisothiazolin-3-one, sodium dehydroacetate, sodium sorbate, sodium 2-pyridinethiol-1-oxide, sodium benzoate, and sodium pentachlorophenolate.

Also, a PH adjuster is not particularly limited as long as the pH can be adjusted to 7 or greater without adversely affecting ink, and various substances can be used according to the intent.

As a pH adjuster, there can be provided, for example, amines such as diethanolamine and triethanolamine, alkali metal hydroxides such as lithium hydroxide, sodium hydroxide, and potassium hydroxide; ammonium hydroxide, quaternary ammonium hydroxides, quaternary phosphonium hydroxides, alkali metal carbonates such as lithium carbonate, sodium carbonate, and potassium carbonate.

Also, as a rust inhibitor, there can be provided, for example, acidic sulfites, sodium thiosulfate, ammonium thiodiglycolate, diisopropylammonium nitrite, pentaerythritol tetranitrate, and dicyclohexylammonium nitrite.

Also, as an antioxidant, there can be provided, for example, phenol-type antioxidants (including hindered phenol-type antioxidants), amine-type antioxidants, sulfur-containing antioxidants, and phosphorus-containing antioxidants.

As a phenol-type antioxidant (including hindered phenol-type antioxidant), there can be provided, for example, butylated hydroxyanisole, 2,6-di-tert-butyl-4-ethylphenol, stearyl β-(3,5-di-tert-butyl-4-hydroxyphenyl)propionate, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 3,9-bis[1,1-dimethyl-2-[β-(3-tert-butyl-4-hydroxy-5-methylphenyl)propionyloxy]ethyl]-2,4,8,10-tetraicosaspiro[5,5]undecane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, and tetrakis[methylene-3-(3',5'-di-tert-butyl-4'-hydroxyphenyl) propionate]methane.

As an amine-type antioxidant, there can be provided, for example, phenyl-β-naphthylamine, phenyl-α-naphthylamine, N,N'-di-sec-butyl-p-phenylenediamine, phenothiazine, N,N'-diphenyl-p-phenylenediamine, 2,6-di-tert-butyl-p-cresol, 2,6-di-tert-butylphenol, 2,4-dimethyl-6-tert-butylphenol, butyl hydroxyanisole, 2,2'-methylenebis(4-methyl-6-tert-butylphenol), 4,4'-butylidenebis(3-methyl-6-tert-butylphenol), 4,4'-thiobis(3-methyl-6-tert-butylphenol), tetrakis[methylene-3-(3,5-di-tert-butyl-4-dihydroxyphenyl) propionate]methane, and 1,1,3-tris(2-methyl-4-hydroxy-5-tert-butylphenyl)butane.

As a sulfur-containing antioxidant, there can be provided, for example, dilauryl 3,3'-thiodipropionate, distearyl thiodipropionate, lauryl stearyl thiodipropionate, dimyristyl 3,3'-thiodipropionate, distearyl β,β'-thiodipropionate, 2-mercaptobenzoimidazole, and dilauryl sulfide.

As a phosphorus-containing antioxidant, there can be provided, for example, triphenyl phosphite, octadecyl phosphite, triisodecyl phosphite, trilauryl trithiophosphite, and trinonyl phenyl phosphite.

Also, as an ultraviolet-ray absorber, there can be provided, for example, benzophenone-type ultraviolet-ray absorbers, benzotriazole-type ultraviolet-ray absorbers, salicylate-type ultraviolet-ray absorbers, cyanoacrylate-type ultraviolet-ray absorbers, and nickel complex-type ultraviolet-ray absorbers.

As a benzophenone-type ultraviolet-ray absorber, there can be provided, for example, 2-hydroxy-4-n-octoxybenzophenone, 2-hydroxy-4-n-dodecyloxybenzophenone, 2,4-dihydroxybenzophenone, 2-hydroxy-4-methoxybenzophenone, and 2,2',4,4'-tetrahydroxybenzophenone.

As a benzotriazole-type ultraviolet-ray absorber, there can be provided, for example, 2-(2'-hydroxy-5'-tert-octylphenyl) benzotriazole, 2-(2'-hydroxy-5'-methylphenyl)benzotriazole, 2-(2'-hydroxy-4'-octoxyphenyl)benzotriazole, and 2-(2'-hydroxy-3'-tert-butyl-5'-methylphenyl)-5-chlorobenzotriazole.

As a salicylate-type ultraviolet-ray absorber, there can be provided, for example, phenyl salicylate, p-tert-butylphenyl salicylate, and p-octylphenyl salicylate.

As a cyanoacrylate-type ultraviolet-ray absorber, there can be provided, for example, ethyl 2-cyano-3,3'-diphenylacrylate, methyl 2-cyano-3-methyl-3-(p-methoxyphenyl)acrylate, and butyl 2-cyano-3-metyl-3-(p-methoxyphenyl)acrylate.

As a nickel complex-type ultraviolet-ray absorber, there can be provided, for example, nickel bis(octylphenyl)sulfide, 2,2'-thiobis(4-tert-octylphalate)-n-butylamine nickel(II), 2,2'-thiobis(4-tert-octylphalate)-2-ethylhexylamine nickel (II), and 2,2'-thiobis(4-tert-octylphalate)triethanolamine nickel(II).

An ink in an ink medium set according to the embodiments of the present invention is manufactured by dissolving or dispersing, at least, water, a coloring agent, and a wetting agent, and if necessary, a penetrating agent and a surfactant, and further if necessary, another component in an aqueous medium and by further stirring and mixing them according to need. The dispersion can be attained by means of, for example, a sand mill, a homogenizer, a ball mill, a paint shaker, or an ultrasound dispersing machine and the stirring and mixing can be attained by a usual stirring machine which uses a stirring blade, a magnetic stirrer, or a high-speed dispersing machine.

The viscosity of ink at 25° C. is preferably equal to or greater than 5 mPa·s and equal to or less than 30 cps, and more preferably, 8-20 mPa·s. If the viscosity is greater than 20 mPa·s, it may be difficult to keep the ejection stability.

Preferably, the pH of ink is, for example, 7-10.

The color of ink is not particularly limited and can be appropriately selected according to the intent, and there can be provided, for example, yellow, magenta, cyan, and black. When an ink set in which at least two kinds of these colors are used in combination is used to conduct recording, a multicolor image can be formed, and when an ink set in which all the colors are used in combination is used to conduct recording, a full-color image can be formed.

Next, examples of ink preparation are described. However, no limitation to them is made.

INK OF MANUFACTURING EXAMPLE 1

(Black Ink)

KM-9036 (TOYO INK MFG. CO., LTD.) (Self-dispersion-type pigment): 50% by weight

Glycerin: 10% by weight 1,3-butanediol: 15% by weight 2-ethyl-1,3-hexanediol: 2% by weight 2-pyrrolidone: 2% by weight Surfactant (1-9): 1% by weight Silicone antifoaming agent KS508 (Shin-Etsu Chemical Co., Ltd.): 0.1% by weight Ion-exchanged water: balance After an ink composition was manufactured in accordance with the formulation described above and sufficiently stirred at room temperature, filtration was conducted through a membrane filter with an average pore size of 1.2 μm, so as to obtain ink of manufacturing example 1.

INK OF MANUFACTURING EXAMPLE 2

(Preparation of Polymer Solution A)

After a 1L flask with a mechanical stirrer, a thermometer, a nitrogen gas inlet tube, a reflux tube, and a dropping funnel was sufficiently filled with nitrogen gas, 11.2 g of styrene, 2.8 g of acrylic acid, 12.0 g of lauryl methacrylate, 4.0 g of poly(ethylene glycol methacrylate), 4.0 g of a styrene macromer and 0.4 g of mercaptoethanol were mixed and the temperature thereof was raised to 65° C. Then, a mixed solution of 100.8 g of styrene, 25.2 g of acrylic acid, 108.0 g of lauryl methacrylate, 36.0 g of poly(ethylene glycol methacrylate), 60.0 g of hydroxyethyl methacrylate, 36.0 g of a styrene macromer, 3.6 g of mercaptoethanol, 2.4 g of azobis(methylvaleronitrile), and 18 g of methyl ethyl ketone was dropped into the flask for 2.5 hours.

After the dropping was completed, a mixed solution of 0.8 g of azobis(methylvaleronitrile) and 18 g of methyl ethyl ketone was dropped into the flask for 0.5 hours. After the maturation at 65° C. for 1 hour, 0.8 g of azobis(methylvaleronitrile) was added and further maturation for 1 hour was conducted. After the completion of the reaction, 364 g of methyl ethyl ketone was put into the flask so as to obtain 800 g of a polymer solution with a concentration of 50%. A portion of the polymer solution was dried and the weight-average molecular weight (Mw) thereof which was measured by means of gel permeation chromatography (standard: polystyrene, solvent: tetrahydrofuran) was 15,000.

(Preparation of Pigment-Containing Polymer Fine Particle Aqueous Dispersion)

After 28 g of polymer solution A, 26 g of C.I. pigment yellow 97, 13.6 g of 1 mol/L aqueous solution of potassium hydroxide, 20 g of methyl ethyl ketone, and 13.6 g of ion-exchanged water were mixed and stirred sufficiently, kneading was conducted using a roll mill. After the obtained paste was thrown into 200 g of ion-exchanged water and sufficient stirring was made, methyl ethyl ketone and water were evaporated using an evaporator so as to obtain a yellow polymer fine particle aqueous dispersion.

(Yellow Ink)

Yellow polymer fine particle dispersion: 40% by weight

Glycerin: 8% by weight 1,3-butanediol: 20% by weight 2,2,4-trimethyl-1,3-penatnediol: 2% by weight Surfactant (1-8): 1.5% by weight Silicone antifoaming agent KS508 (Shin-Etsu Chemical Co., Ltd.): 0.1% by weight Ion-exchanged water: balance After an ink composition was manufactured in accordance with the formulation described above and sufficiently stirred at room temperature, filtration was conducted through a membrane filter with an average pore size of 1.2 μm, so as to obtain ink of manufacturing example 2.

INK OF MANUFACTURING EXAMPLE 3

A magenta polymer fine particle aqueous dispersion was similarly obtained except that the kind of pigment was changed to C.I. pigment red 122.

(Magenta Ink)

Magenta polymer fine particle dispersion: 50% by weight

Glycerin: 10% by weight 1,3-butanediol: 18% by weight 2,2,4-trimethyl-1,3-penatnediol: 2% by weight Surfactant (1-8): 1.5% by weight Silicone antifoaming agent KS508 (Shin-Etsu Chemical Co., Ltd.): 0.1% by weight Ion-exchanged water: balance After an ink composition was manufactured in accordance with the formulation described above and sufficiently stirred at room temperature, filtration was conducted through a membrane filter with an average pore size of 1.2 μm, so as to obtain ink of manufacturing example 3.

INK OF MANUFACTURING EXAMPLE 4

(Preparation of Pigment-Containing Polymer Fine Particle Aqueous Dispersion)

A cyan polymer fine particle aqueous dispersion was similarly obtained except that the kind of pigment was changed to C.I. pigment blue 15:3.

(Cyan Ink)

Cyan polymer fine particle dispersion: 40% by weight

Glycerin: 8% by weight 1,3-butanediol: 20% by weight 2,2,4-trimethyl-1,3-penatnediol: 2% by weight Surfactant (1-8): 1.5% by weight Silicone antifoaming agent KS508 (Shin-Etsu Chemical Co., Ltd.): 0.1% by weight Ion-exchanged water: balance After an ink composition was manufactured in accordance with the formulation described above and sufficiently stirred at room temperature, filtration was conducted through a membrane filter with an average pore size of 1.2 μm, so as to obtain ink of manufacturing example 4.

It was confirmed that each ink of manufacturing example described above contained 6% by weight or more of a pigment, while the viscosity thereof was generally 8 mPa·s at 25° C. and the surface tension thereof was generally 25 mN/m at 25° C. Also, in regard to each ink of manufacturing example described above, it was confirmed that the rate of viscosity increase thereof (mPa·s/%) with water evaporation was equal to or less than 1.0 until the rate of water evaporation per the total weight of the ink became 30% and there was a rate of viscosity increase which was greater than 50 in a rate of water evaporation of 30-45% while the average particle diameter of a coloring agent in the ink at a rate of viscosity increase which was greater than 50 was equal to or less than five times the initial average particle diameter and equal to or less than 0.8 μm.

As such a recording liquid is used, no nozzle clogging is caused even though it is left for a long period of time, and high quality and high speed printing can be attained on a normal paper sheet. In addition, if the recording liquid were dried and thickened on the nozzle such that no ejection from the nozzle could be conducted, the recording liquid would not cause nozzle clogging which could be caused by increase of the particle size of a pigment, etc. Therefore, it has an advantage such that easier recovery can be conducted by a simple maintenance or recovery operation.

Then, even when such a recording liquid is used, the recording liquid ejected in the capping member can be absorbed in the absorbing member and further sucked and ejected by using the configuration of the capping member described above. As a result, the residual of the recording liquid (liquid) in the capping member is reduced and moisture retention is conducted by the absorbing member, so that defective ejection caused by moisture absorption of remaining recording liquid can be prevented.

Additionally, although examples of one suction cap are described in the embodiments described above, the same can be similarly applied in the case of including a moisture retention cap per each head or one or more moisture retention caps, the number of which is less than the number of recording heads, and a maintenance or recovery mechanism having one or more suction and moisture retention caps.

Also, although the configuration of a printer as an image forming apparatus according to the present invention is described in each of the embodiments described above, no limitation to this is made and, for example, the same can be applied to another image forming apparatus such as a printer/facsimile/copia multi-function processing machine. Also, the same can be applied to an image forming apparatus using, for example, another recording liquid which is liquid other than ink or fixation treatment liquid, and another device for ejecting a liquid drop.

Appendix

Typical embodiments (1) to (18) of the present invention are to provide a capping member, head maintenance or recovery device, device for ejecting a liquid drop, and image forming apparatus, which efficiently prevents defective ejection caused by remaining liquid in the capping member which liquid absorbs water content of the liquid in the head.

Embodiment (1) is a head capping member for capping an ejection face of a liquid ejecting head which face is provided with a nozzle for ejecting a liquid drop, characterized by comprising a contact part which contacts the ejection face of the head and is made of an elastic member and a recess which forms a closed space together with the ejection head when the contact part contacts the ejection head, wherein a flat part is formed around the recess and an absorbing member is provided on the flat part so as to cover the recess.

Embodiment (2) is the head capping member as described in embodiment (1) above, characterized in that a bottom face of the recess has at least two inclined faces for guiding liquid to one outlet.

Embodiment (3) is the head capping member as described in embodiment (1) or (2) above, characterized in that widths of flat parts at both ends thereof in a longitudinal direction thereof are not greater than 3 mm.

Embodiment (4) is the head capping member as described in any of embodiments (1) to (3) above, characterized in that a top face of the absorbing member is located at a side of the contact part with respect to a border between the contact part and the recess.

Embodiment (5) is the head capping member as described in any of embodiments (1) to (4) above, characterized by comprising a recess in the flat part.

Embodiment (6) is the head capping member as described in any of embodiments (1) to (5) above, characterized in that a pore size of the absorbing member is equal to or greater than 300 μm.

Embodiment (7) is the head capping member as described in any of embodiments (1) to (6) above, characterized in that the absorbing member is fixed on an entire circumference of a flat part formed around the recess.

Embodiment (8) is the head capping member as described in any of embodiments (1) to (7) above, characterized in that a surface of a flat part formed around the recess is roughened.

Embodiment (9) is the head capping member as described in any of embodiments (1) to (8) above, characterized in that an inside perimeter of a flat part formed around the recess is formed in a planar and rectangular shape and a corner thereof is formed in an R shape.

Embodiment (10) is the head capping member as described in embodiment (1) above, characterized by comprising a first member having the contact part and a second member having the recess and the flat part, wherein an absorbing member provided on the flat part is intervened and fixed between the first member and the second member.

Embodiment (11) is the head capping member as described in embodiment (10) above, characterized in that the absorbing member is intervened between the first member and the second member along an entire circumference thereof.

Embodiment (12) is the head capping member as described in embodiment (10) or (11) above, characterized in that at least one of the first member and the second member is provided with a rib for pressing the absorbing member.

Embodiment (13) is the head capping member as described in any of embodiments (10) to (12) above, characterized in that the first member and the second member are welded.

Embodiment (14) is a head maintenance or recovery device for conducting maintenance or recovery of a liquid ejecting head, comprising a capping member for capping an ejection face of the liquid ejecting head, from which face a liquid drop is ejected, characterized in that the capping member is the head capping member as described in any of embodiments (1) to (13) above.

Embodiment (15) is a device for ejecting a liquid drop from a liquid ejecting head, characterized by comprising the head maintenance or recovery device as described in embodiment (14) above.

Embodiment (16) is an image forming apparatus for forming an image by ejecting a liquid drop from a liquid ejecting head, characterized by comprising the head maintenance or recovery device as described in embodiment (14) above.

Embodiment (17) is the image forming apparatus as described in embodiment (16) above, characterized by ejecting a recording liquid comprising, at least, water, a coloring agent, and a wetting agent, wherein a content of the coloring agent is equal to or greater than 6% by weight, while the viscosity thereof is 5-30 mPa·s at 25° C. and the surface tension thereof is 15-40 mN/m at 25° C.

Embodiment (18) is the image forming apparatus as described in embodiment (17) above, characterized by ejecting a recording liquid which comprises, at least, a coloring agent, wetting agent and penetration enhancer dispersed in water, whose rate of viscosity increase (mPa·s/%) involved with water vaporization is equal to or less than 1.0 until a rate of water vaporization per a total weight of recording liquid becomes 30%, and which liquid is configured to have a rate of viscosity increase which is greater than 50 at a rate of water vaporization of 30-45%.

According to a capping member as described in at least one of embodiments (1)-(18) above, particularly, liquid can be sucked from an equally thin and long absorbing member and ejected to one outlet even in the case of a long capping member so that the residual of the liquid in the capping member can be reduced and the residual of thickened liquid can be prevented, since a configuration is provided such that a contact part composed of an elastic member and contacting the ejection face of the head and a recess for forming a closed space together with the ejection face at the condition that the contact part contacts the ejection face are included wherein a flat part is formed around the recess and an absorbing member is provided so as to cover the recess in the flat part.

According to a head maintenance or recovery device as described in at least one of embodiments (1) to (18) above, the residual of liquid in a capping member is reduced so that highly reliable maintenance or recovery can be conducted since a capping member as described in at least one of embodiments (1) to (18) above is included.

According to a device for ejecting a liquid drop as described in at least one of the embodiments (1) to (18) above, the generation of defective ejection caused by the residual of liquid in a capping member can be prevented and stable drop ejection can be conducted, since a head maintenance or recovery device as described in at least one of embodiments (1) to (18) above is included.

According to an image forming apparatus as described in at least one of embodiments (1) to (18) above, the generation of defective ejection caused by the residual of liquid in a capping member can be prevented and stable drop ejection, and therefore, stable image formation can be conducted, since a head maintenance or recovery device as described in at least one of embodiments (1) to (18) above is included.

The present invention is not limited to the specifically disclosed embodiments or examples, and the embodiments or examples may be varied or modified without departing from the scope of the present invention.

The present application claims the benefit of the foreign priority based on Japanese Patent Applications No. 2006-045954 filed on Feb. 22, 2006 and No. 2006-302176 filed on Nov. 8, 2006, the entire contents of which are hereby incorporated by reference.

What is claimed is:

1. A head capping member for capping an ejection face of a liquid ejecting head which face is provided with a nozzle for ejecting a liquid drop, comprising:

a contact part which contacts the ejection face of the head and is made of an elastic member;

a recess which forms a closed space together with the ejection head when the contact part contacts the ejection head;

a flat part being formed around the recess; and an absorbing member being provided on the flat part so as to cover the recess, wherein a bottom face of the recess has at least two inclined faces for guiding liquid to one outlet.

2. The head capping member as claimed in claim 1, wherein widths of flat parts at both ends thereof in a longitudinal direction thereof are not greater than 3 mm.

3. The head capping member as claimed in claim 1, wherein a top face of the absorbing member is located at a side of the contact part with respect to a border between the contact part and the recess.

4. The head capping member as claimed in claim 1, which comprises a recess in the flat part.

5. The head capping member as claimed in claim 1, wherein a pore size of the absorbing member is equal to or greater than 300 μm.

6. The head capping member as claimed in claim 1, wherein the absorbing member is fixed on an entire circumference of a flat part formed around the recess.

7. The head capping member as claimed in claim 1, wherein a surface of a flat part formed around the recess is roughened.

8. The head capping member as claimed in claim 1, wherein an inside perimeter of a flat part formed around the recess is formed in a planar and rectangular shape and a corner thereof is formed in an R shape.

9. The head capping member as claimed in claim 1, which comprises a first member having the contact part and a second member having the recess and the flat part, wherein an absorbing member provided on the flat part is intervened and fixed between the first member and the second member.

10. The head capping member as claimed in claim 9, wherein the absorbing member is intervened between the first member and the second member along an entire circumference thereof

11. The head capping member as claimed in claim 9, wherein the first member and the second member are welded.

12. A head maintenance or recovery device for conducting maintenance or recovery of a liquid ejecting head, comprising a capping member for capping an ejection face of the liquid ejecting head, from which face a liquid drop is ejected, wherein the capping member is the head capping member as claimed in claim 1.

13. A device for ejecting a liquid drop from a liquid ejecting head, comprising the head maintenance or recovery device as claimed in claim 12.

14. An image forming apparatus for forming an image by ejecting a liquid drop from a liquid ejecting head, comprising the head maintenance or recovery device as claimed in claim 12.

15. The image forming apparatus as claimed in claim 14, which ejects a recording liquid comprising, at least, water, a coloring agent, and a wetting agent, wherein a content of the coloring agent is equal to or greater than 6 % by weight, while a viscosity thereof is 5-30 mPa·s at 25° C. and a surface tension thereof is 15-40 mN/m at 25° C.

16. The head capping member as claimed in claim 1, wherein the absorbing member is adhered to the flat part.

17. A head capping member for capping an ejection face of a liquid ejecting head which face is provided with a nozzle for ejecting a liquid drop, comprising:

a contact part which contacts the ejection face of the head and is made of an elastic member;

a recess which forms a closed space together with the ejection head when the contact part contacts the ejection head;

a flat part being formed around the recess;

an absorbing member being provided on the flat part so as to cover the recess;

a first member having the contact part; and a second member having the recess and the flat part, wherein an absorbing member provided on the flat part is intervened and fixed between the first member and the second member and at least one of the first member and the second member is provided with a rib for pressing the absorbing member.

18. The head capping member as claimed in claim 17, further comprising:

at least one claw portion formed on the first member configured to engage the second member and hold the first member to the second member and a sealing member positioned between the first member and the second member.

19. An image forming apparatus for forming an image by ejecting a liquid drop from a liquid ejecting head, comprising a head maintenance or recovery device for conducting maintenance or recovery of a liquid ejecting head, comprising a capping member for capping an ejection face of the liquid ejecting head, from which face a liquid drop is ejected, the capping member comprising:

a contact part which contacts the ejection face of the head and is made of an elastic member;

a recess which forms a closed space together with the ejection head when the contact part contacts the ejection head;

a flat part being formed around the recess; and an absorbing member being provided on the flat part so as to cover the recess, wherein the liquid drop ejected from the liquid ejecting head is a recording liquid which comprises, at least, a coloring agent, wetting agent and penetration enhancer dispersed in water, a content of the coloring agent is equal to or greater than 6% by weight, while the viscosity thereof is 5-30 mPa·s at 25° C. and the surface tension thereof is 15-40 mN/m at 25° C. and a rate of viscosity increase (mPa·s/%) of the recording liquid involved with water vaporization is equal to or less than 1.0 until a rate of water vaporization per a total weight of recording liquid becomes 30%, and which liquid is configured to have a rate of viscosity increase which is greater than 50 at a rate of water vaporization of 30-45%.

* * * * *